US011795023B2

(12) United States Patent
Brugger et al.

(10) Patent No.: US 11,795,023 B2
(45) Date of Patent: Oct. 24, 2023

(54) PAPER SHEET STORAGE DEVICE AND PAPER SHEET PROCESSING DEVICE

(71) Applicant: Glory Ltd., Himeji (JP)

(72) Inventors: Robert Brugger, Himeji (JP); Reto Moser, Himeji (JP); Kei Isshiki, Himeji (JP); Takuro Hamada, Himeji (JP)

(73) Assignee: GLORY LTD., Himeji (JP)

( * ) Notice: Subject to any disclaimer, the term of this patent is extended or adjusted under 35 U.S.C. 154(b) by 371 days.

(21) Appl. No.: 17/244,955

(22) Filed: Apr. 30, 2021

(65) Prior Publication Data

US 2021/0253388 A1 Aug. 19, 2021

Related U.S. Application Data

(63) Continuation of application No. PCT/JP2019/042266, filed on Oct. 29, 2019.

(30) Foreign Application Priority Data

Nov. 2, 2018 (JP) ..... 2018-207486

(51) Int. Cl.
*B65H 29/00* (2006.01)
*G07D 11/16* (2019.01)
*G07D 11/12* (2019.01)

(52) U.S. Cl.
CPC ..... *B65H 29/006* (2013.01); *G07D 11/12* (2019.01); *G07D 11/16* (2019.01);
(Continued)

(58) Field of Classification Search
CPC ..... B65H 29/006; B65H 2301/41912; B65H 2403/483
See application file for complete search history.

(56) References Cited

U.S. PATENT DOCUMENTS 2,981,492 A 4/1961 Simjian
4,871,125 A 10/1989 Haueter
(Continued)

FOREIGN PATENT DOCUMENTS

GB 2387167 A * 10/2003 ..... B65H 29/006
GB 2387167 A 10/2003
(Continued)

OTHER PUBLICATIONS

International Search Report and Written Opinion dated Dec. 10, 2019, received for PCT Application No. PCT/JP2019/042266, Filed on Oct. 29, 2019, 8 pages including English Translation.

*Primary Examiner* — Jeremy R Severson
(74) *Attorney, Agent, or Firm* — XSENSUS LLP

(57) ABSTRACT

A sheet storage device includes a first reel, a second reel, a third reel, a shaft, a drum, a first differential mechanism and a second differential mechanism. Tips first, second and third tapes respectively unwound from the first reel, the second reel, and the third reel are fixed to the drum, and the drum winds up sheets together with the first, second and third tapes. The first differential mechanism distributes torque input from a torque source to a first path and a second path. The second differential mechanism is provided in the second path and distributes the torque that has been distributed by the first differential mechanism to a third path and a fourth path. The first reel is located in the first path, the second reel is located in the third path, and the third reel is located in the fourth path.

16 Claims, 16 Drawing Sheets

(52) U.S. Cl.
CPC ..... *B65H 2301/41912* (2013.01); *B65H 2403/483* (2013.01); *B65H 2701/1912* (2013.01)

(56) References Cited

U.S. PATENT DOCUMENTS

| | | | |
|---|---|---|---|
| 2012/0326384 | A1 | 12/2012 | Arikata et al. |
| 2014/0090949 | A1 | 4/2014 | Suetaka |
| 2016/0335829 | A1 | 11/2016 | Takada et al. |
| 2020/0028876 | A1† | 1/2020 | Cohen |
| 2020/0231150 | A1† | 7/2020 | Takahashi |
| 2020/0320114 | A1† | 10/2020 | Sparrow |

FOREIGN PATENT DOCUMENTS

| | | | |
|---|---|---|---|
| JP | 10-181972 | A | 7/1998 |
| JP | 2013-8342 | A | 1/2013 |
| JP | 2015-146167 | A | 8/2015 |
| JP | 2016-167186 | A | 9/2016 |
| JP | 6083943 | B2 | 2/2017 |
| JP | 2017-56732 | A | 3/2017 |
| JP | 2018-77661 | A | 5/2018 |
| WO | 2012/008026 | A1 | 1/2012 |

* cited by examiner
† cited by third party

PAPER SHEET STORAGE DEVICE AND PAPER SHEET PROCESSING DEVICE

CROSS-REFERENCE TO RELATED APPLICATIONS

This application is a bypass continuation of International Patent Cooperation Treaty Application No. PCT/JP2019/042266, filed on Oct. 29, 2019, which claims priority to Japanese Patent Application No. 2018-207486, filed on Nov. 2, 2018, the entire disclosures of each are incorporated herein by reference.

BACKGROUND

A conventional banknote depositing and dispensing machine includes a temporary storage unit. This temporary storage unit uses two sets of tapes, each set including a pair of a top tape and a bottom tape. In each set of tapes, the top tape and the bottom tape overlap each other so as to sandwich both end parts of a banknote. A drum winds up the tapes and the banknote. A pair of tape reels around which the tapes are wound are disposed so as to face each other in the vertical direction in the temporary storage unit. Therefore, two shafts supporting the tape reels are disposed in parallel in the vertical direction, and each shaft supports the two tape reels.

SUMMARY

In accordance with the present disclosure, a sheet storage device includes a first reel around which a first tape is wound; a second reel around which a second tape is wound; a third reel around which a third tape is wound; a shaft that rotatably supports the first reel, the second reel, and the third reel; a drum to which tips of the first, second and third tapes respectively unwound from the first reel, the second reel, and the third reel are fixed, and which winds up sheets together with the first, second and third tapes; a torque source that generates torque to be applied to the first reel, the second reel, and the third reel so that a predetermined tension is generated on each of the tapes during rotation of the drum; a first differential mechanism provided in a torque transmission path, the first differential mechanism distributing the torque input from the torque source to a first path and a second path; and a second differential mechanism that is provided in the second path and distributes the torque that has been distributed by the first differential mechanism to a third path and a fourth path, wherein the first reel is located in the first path, the second reel is located in the third path, and the third reel is located in the fourth path.

DETAILED DESCRIPTION OF THE DRAWINGS

Figure 1:
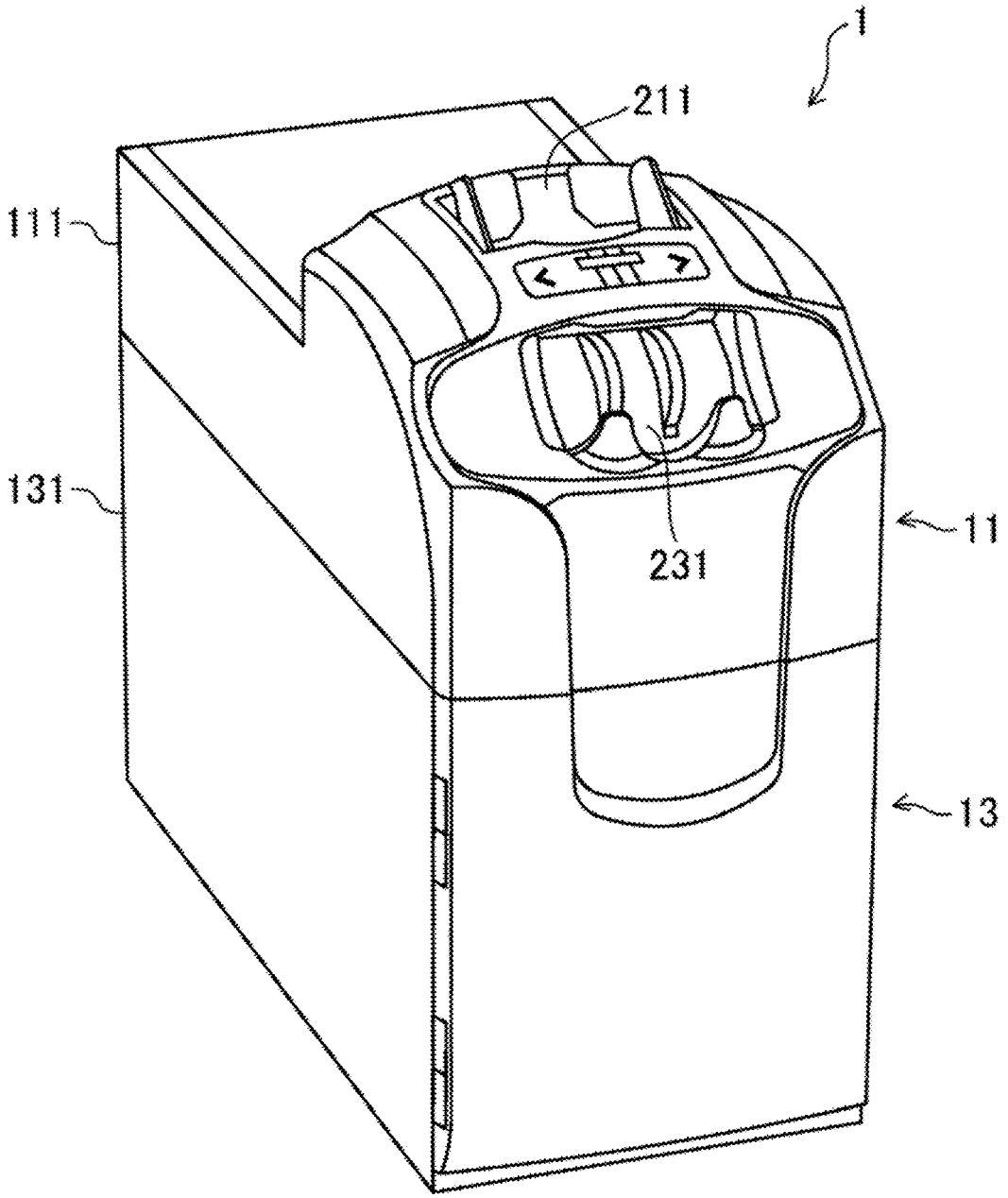
FIG. 1 is a perspective view illustrating an external appearance of a banknote processing device.

In the temporary storage unit, when the diameter of the drum on which the banknote is wound up together with the tapes becomes large, the size of the diameter of the drum may be non-uniform in the axial direction of the drum. If the size of the diameter of the drum is non-uniform in the axial direction, the winding speeds of the tapes during rotation of the drum differ among the plurality of tapes arranged in the axial direction. Therefore, tensions generated on the plurality of tapes are unequal, which causes displacement of the sheet.

In view of this, the conventional temporary storage unit is provided with a torque limiter for each tape reel to equalize tensions of the tapes.

However, the conventional temporary storage unit has a problem that a large number of torque limiters are required.

Further, it is found from the study of the inventors of the present application that the configuration in which the torque limiter is attached to each of the tape reels cannot equalize tensions generated on all the tapes. That is, in the conventional temporary storage unit including a torque limiter, tensions are unequal among the plurality of tapes, by which the banknote wound around the drum is displaced. If the banknote wound around the drum is displaced, the banknote is likely to be jammed.

The technique disclosed herein equalizes or substantially equalizes tensions generated on a plurality of tapes in a sheet storage device.

Specifically, a sheet storage device disclosed herein includes: a first reel, a second reel, and a third reel on which tapes are wound, respectively; at least one shaft that rotatably supports the first reel, the second reel, and the third reel; a drum to which tips of the tapes respectively unwound from the first reel, the second reel, and the third reel are fixed, and which winds up sheet together with the tapes; a torque source that generates torque to be applied to the first reel, the second reel, and the third reel so that a predetermined tension is generated on each of the tapes during rotation of the drum; a first differential mechanism that is provided in a torque transmission path for transmitting torque to the first reel, the second reel, and the third reel, and that distributes the torque input from the torque source to a first path and a second path; and a second differential mechanism that is provided in the second path and distributes the torque which has been distributed by the first differential mechanism to a third path and a fourth path.

The first reel is provided in the first path, the second reel is provided in the third path, and the third reel is provided in the fourth path.

According to this configuration, optimum torque can be applied to each of the first reel, the second reel, and the third reel. Even when the diameter of the drum around which the tapes and sheet are wound is non-uniform in the axial direction, tensions generated on the three tapes are equalized or substantially equalized.

The first differential mechanism may include a planetary gear mechanism, and the second differential mechanism may include a bevel gear.

The first differential mechanism and the second differential mechanism can distribute torque from one torque source to the first reel, the second reel, and the third reel in cooperation with each other.

The first differential mechanism may include a sun gear, a ring gear, and a carrier that supports a planetary gear that meshes with each of the sun gear and the ring gear, the torque from the torque source may be input to the carrier, the first reel may be connected to the sun gear so as to rotate integrally with the sun gear, and the ring gear may be fixed to the shaft so as to rotate integrally with the shaft.

A gear ratio between the sun gear and the ring gear may be 1/2. With this configuration, the first differential mechanism can distribute ⅓ of the torque from the torque source to the first reel through the sun gear and ⅔ of the torque from the torque source to the shaft through the ring gear.

The first differential mechanism may be located at an end of the shaft, the first reel may be located adjacent to the first differential mechanism, and the first reel and the sun gear may be connected by a pipe fitted onto the shaft.

This configuration is advantageous for making the torque transmission path compact.

The second differential mechanism may include a pinion gear rotatably supported by a pin fixed perpendicularly to the shaft, a first side gear that rotates integrally with the second reel and meshes with the pinion gear, and a second side gear that rotates integrally with the third reel and meshes with the pinion gear.

The sheet storage device may further include: a fourth reel around which a tape is wound; and a third differential mechanism that is provided in the first path and distributes the torque which has been distributed by the first differential mechanism to a fifth path and a sixth path, wherein the fourth reel may be rotatably supported by the shaft, a tip of the tape unwound from the fourth reel may be fixed to the drum, the first reel may be provided in the fifth path, and the fourth reel may be provided in the sixth path.

According to this configuration, optimum torque can be applied to each of the first reel, the second reel, the third reel, and the fourth reel. As a result, the tensions generated on the four tapes are equalized or substantially equalized, even when the diameter of the drum in the axial direction is non-uniform.

The first differential mechanism, the second differential mechanism, and the third differential mechanism each may include a bevel gear.

The shaft may be divided into a first shaft and a second shaft that are coaxially arranged, the first differential mechanism may include a first side gear fixed to the first shaft, a second side gear fixed to the second shaft, a pinion case rotatably supported by the first shaft and the second shaft, and a pinion gear that is rotatably supported by a pin which is fixed to the pinion case so as to be perpendicular to the shaft, the pinion gear meshing with each of the first side gear and the second side gear, and the torque from the torque source may be input to the pinion case.

The second differential mechanism may include a first pinion gear rotatably supported by a pin fixed perpendicularly to the second shaft, a first side gear that rotates integrally with the second reel and meshes with the first pinion gear, and a second side gear that rotates integrally with the third reel and meshes with the first pinion gear, and the third differential mechanism may include a second pinion gear rotatably supported by a pin fixed perpendicularly to the first shaft, a third side gear that rotates integrally with the first reel and meshes with the second pinion gear, and a fourth side gear that rotates integrally with the fourth reel and meshes with the second pinion gear.

A sheet processing device disclosed herein includes a storage for sheet, the storage including: a first reel, a second reel, and a third reel around which tapes are wound, respectively; at least one shaft that rotatably supports the first reel, the second reel, and the third reel; a drum to which tips of the tapes respectively unwound from the first reel, the second reel, and the third reel are fixed, and which winds up sheet together with the tapes; a torque source that generates torque to be applied to the first reel, the second reel, and the third reel so that a predetermined tension is generated on each of the tapes during rotation of the drum; a first differential mechanism that is provided in a torque transmission path for transmitting torque to the first reel, the second reel, and the third reel, the first differential mechanism distributing the torque input from the torque source to a first path and a second path; and a second differential mechanism that is provided in the second path and distributes the torque which has been distributed by the first differential mechanism to a third path and a fourth path, the first reel being provided in the first path, the second reel being provided in the third path, and the third reel being provided in the fourth path.

The storage further may include a fourth reel around which a tape is wound, and a third differential mechanism that is disposed in the first path and that distributes the torque which has been distributed by the first differential mechanism to a fifth path and a sixth path, the fourth reel may be rotatably supported by the shaft, a tip of the tape unwound from the fourth reel may be fixed to the drum, the first reel may be provided in the fifth path, and the fourth reel may be provided in the sixth path.

As described above, according to the abovementioned sheet storage device, tensions generated on the plurality of tapes can be equalized or substantially equalized. Further, the above-mentioned sheet processing device is advantageous in improving storage quality of sheet in the storages.

Figure 2:
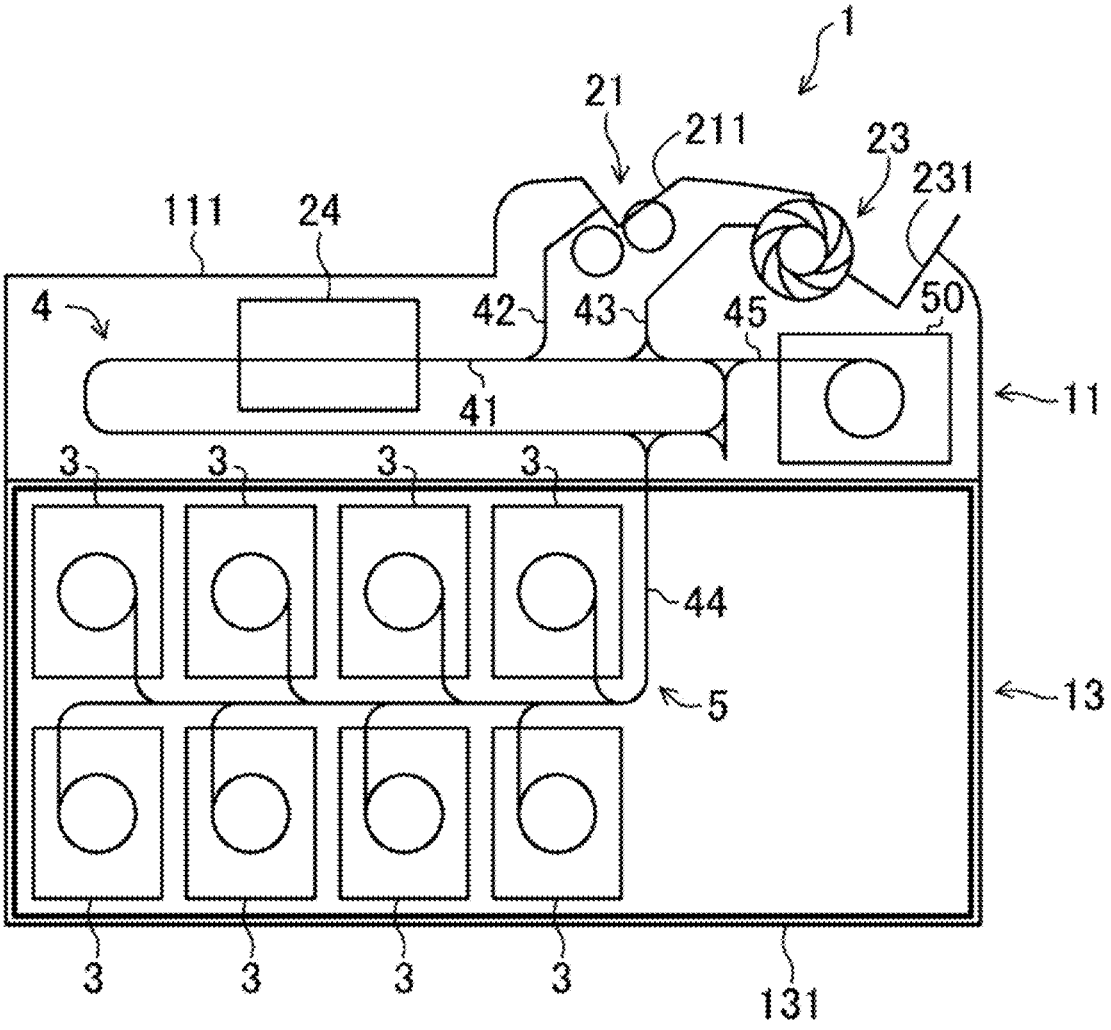
FIG. 2 is a schematic view illustrating an example configuration of the banknote processing device.

Embodiments of a sheet storage device and a sheet processing device will be described below in detail with reference to the drawings. The following description indicates an example of the sheet storage device and the sheet processing device. Banknote storage device 3 illustrated in FIG. 2 is an exemplary implementation of a sheet storage device.

FIG. 1 shows a banknote processing device 1 as the sheet processing device. The banknote processing device 1 is a device installed in a financial institution such as a bank and executes various processes including a depositing process and a dispensing process. Note that the banknote processing device 1 can also be installed and used in, for example, a back office of a retail store, in addition to being installed in a financial institution.

(Overall Configuration of Banknote Processing Device)

FIG. 1 illustrates the external appearance of the banknote processing device 1. FIG. 2 illustrates the internal configuration of the banknote processing device 1.

The banknote processing device 1 handles loose banknotes. The banknote processing device 1 includes an upper handling unit 11 and a lower safe unit 13. A depositing unit 21, a dispensing unit 23, a recognition unit 24, a temporary storage unit 50, and a part of a transport unit 4 are disposed in an upper housing 111 constituting the handling unit 11.

The safe unit 13 is comprised of a safe housing 131. A storage device 5 and a part of the transport unit 4 are disposed inside the safe housing 131. The safe housing 131 is configured to protect the storage device 5 at a security level equal to or higher than a predetermined level. The security level of the safe housing 131 is higher than that of the upper housing 111.

The depositing unit 21 is a portion of the device where the banknotes are inserted, for example, in a depositing process. The depositing unit 21 has an inlet 211. The deposit slot 211 is open at the upper surface of the upper housing 111. The user inserts the banknotes into the depositing unit 21 via the inlet 211. The depositing unit 21 has a mechanism that takes the inserted banknotes one by one into the device.

The dispenser 23 is a section to which banknotes are conveyed during, for example, a dispensing process. The dispenser 23 can be used for various purposes. The dispenser 23 is configured to collect a plurality of banknotes. The dispenser 23 has a dispensing slot 231. The dispensing slot 231 is open at the upper surface of the upper housing 111. The user can take out the banknotes accumulated in the dispenser 23 through the dispensing slot 231. Note that the dispensing slot 231 may be provided with a shutter that opens and closes.

The recognition unit 24 is provided in a loop transport path 41 which will be described later. The recognition unit 24 identifies at least authenticity, denomination, and fitness for each banknote conveyed along the loop transport path 41.

The temporary storage unit 50 is configured to be able to take and store the banknotes therein, and to feed the banknotes stored therein. The temporary storage unit 50 has a so-called tape-winding storing mechanism. The temporary storage unit 50 temporarily stores the banknotes to be deposited, for example, in the depositing process. When the depositing process is confirmed, the temporary storage unit 50 feeds the banknotes stored therein. The fed banknotes are stored in the storage device 5 which will be described later. The temporary storage unit 50 can be used for various other applications.

The temporary storage unit 50 is disposed on a front side in the upper housing 111. The temporary storage unit 50 is detachably installed in the upper housing 111. The banknote processing device 1 is configured to be able to operate without the temporary storage unit 50.

The storage device 5 has a plurality of banknote storage devices 3. The banknote handling apparatus 1 shown in the drawing has eight banknote storage devices 3. The banknote storage devices 3 are arranged side by side in the vertical direction and the horizontal direction in the safe housing 131. Note that any number of banknote storage devices 3 and any arrangement of the banknote storage devices 3 may be applied.

Each of the banknote storage devices 3 is configured to be able to take and store the banknotes therein, and to feed the banknotes stored therein. The configuration of the banknote storage device 3 will be described later.

The transport unit 4 has a transport path. The transport unit 4 transports the banknotes along the transport path one by one at intervals, for example, with a long edge of each banknote facing forward. The transport path is comprised of a combination of a large number of rollers, a plurality of belts, a motor for driving the rollers, and a plurality of guides.

The transport unit 4 has a loop transport path 41 provided in the upper housing 111. The loop transport path 41 passes through the recognition unit 24, as described above. The transport unit 4 transports the banknotes along the loop transport path 41 in the clockwise direction and the counterclockwise direction in FIG. 1.

The depositing unit 21 is connected to the loop transport path 41 via a connection path 42. The dispensing unit 23 is connected to the loop transport path 41 via a connection path 43.

Each of the plurality of banknote storage devices 3 is connected to the loop transport path 41 via a connection path 44. The connection path 44 is diverged and connected to each of the plurality of banknote storage devices 3. The temporary storage unit 50 is connected to the loop transport path 41 via a connection path 45.

A diverter for changing the destination of the banknotes is provided at a junction between the loop transport path 41 and each of the connection paths 42, 43, 44, and 45. Further, diverters are provided at respective diversion points of the connection path 44.

A tracking sensor that detects the passage of the banknotes is provided for each of the loop transport path 41 and the connection paths 42, 43, 44, and 45. Receiving a command from a controller, the transport unit 4 controls the diverters of the transport unit 4 based on the detection signals of the tracking sensors to transport each banknote to a predetermined destination.

It will be briefly described below how the banknote handling apparatus 1 performs the depositing process and the dispensing process.

(Depositing Process)

The user inserts the banknotes to be deposited into the depositing unit 21. The depositing unit 21 takes the banknotes one by one into the device. The transport unit 4 transports the banknotes to the recognition unit 24 through the connection path 42 and the loop transport path 41. The recognition unit 24 recognizes the banknotes. The transport unit 4 transports the banknotes that have passed through the recognition unit 24 to any one of the plurality of banknote storing units 3, via the connection path 44. The banknote storage devices 3 store the banknotes. The depositing process ends when all the banknotes that can be deposited are stored in the banknote storage devices 3.

In the case of using the temporary storage unit 50 during the depositing process, the transport unit 4 transports the banknotes that have passed through the recognition unit 24 to the temporary storage unit 50 via the connection path 45. After the depositing process is confirmed, the temporary storage unit 50 feeds the banknotes stored therein. The transport unit 4 transports the banknotes fed by the temporary storage unit 50 to any one of the plurality of banknote storing units 3, via the connection path 44.

(Dispensing Process)

During dispensing process, the banknote storage devices 3 feed the banknotes to be dispensed. The transport unit 4 transports the banknotes to the recognition unit 24 through the connection path 44 and the loop transport path 41. The recognition unit 24 recognizes the banknotes. After the recognition of the banknotes, the transport unit 4 transports the banknotes to the dispensing unit 23 through the loop transport path 41 and the connection path 43. The dispensing process ends when all the banknotes to be dispensed are dispensed to the dispensing unit 23.

(Configuration of Banknote Storage Device)

Figure 3:
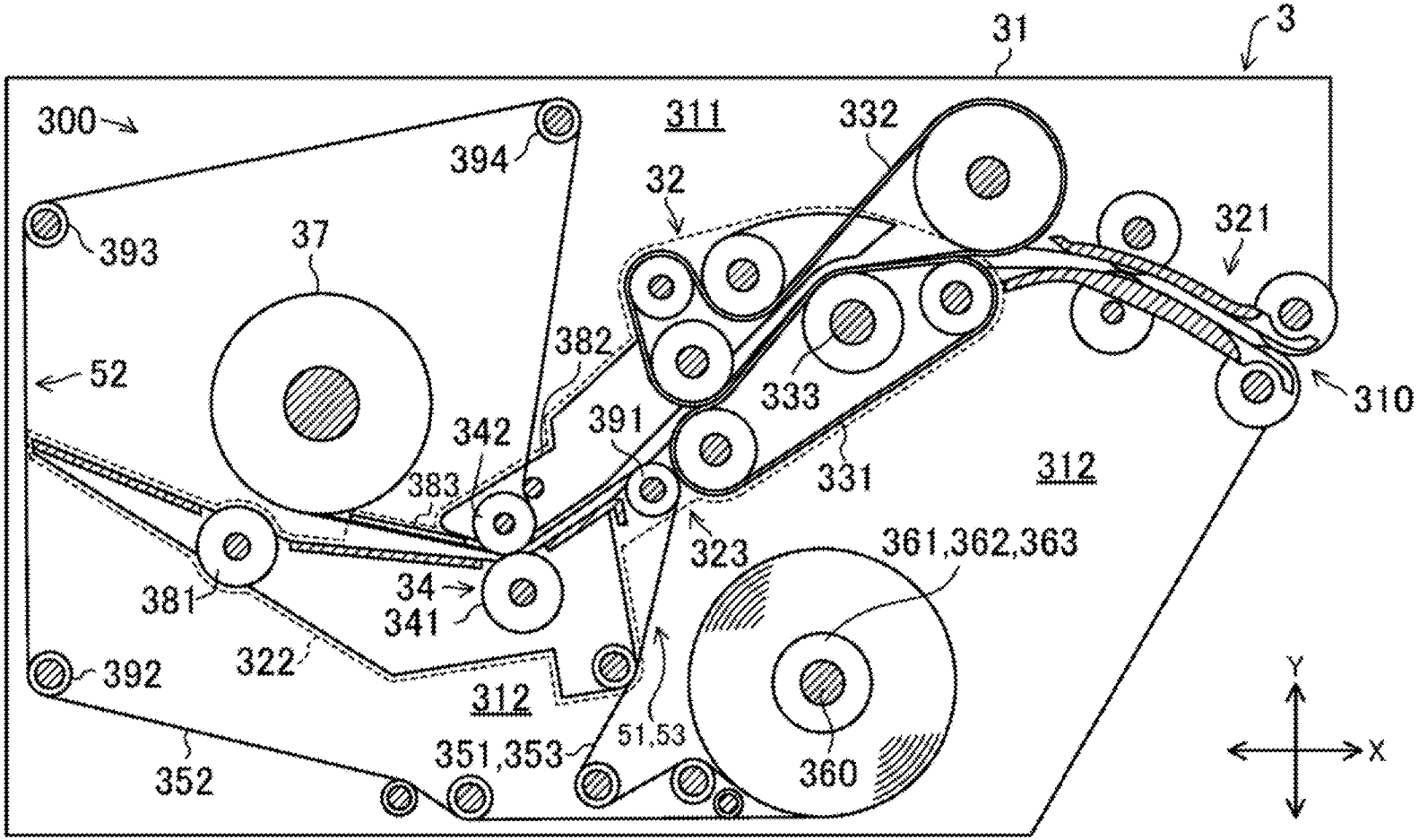
FIG. 3 is a sectional view illustrating an example configuration of a banknote storage device, indicating a state in which the number of stored banknotes is zero.
Figure 4:
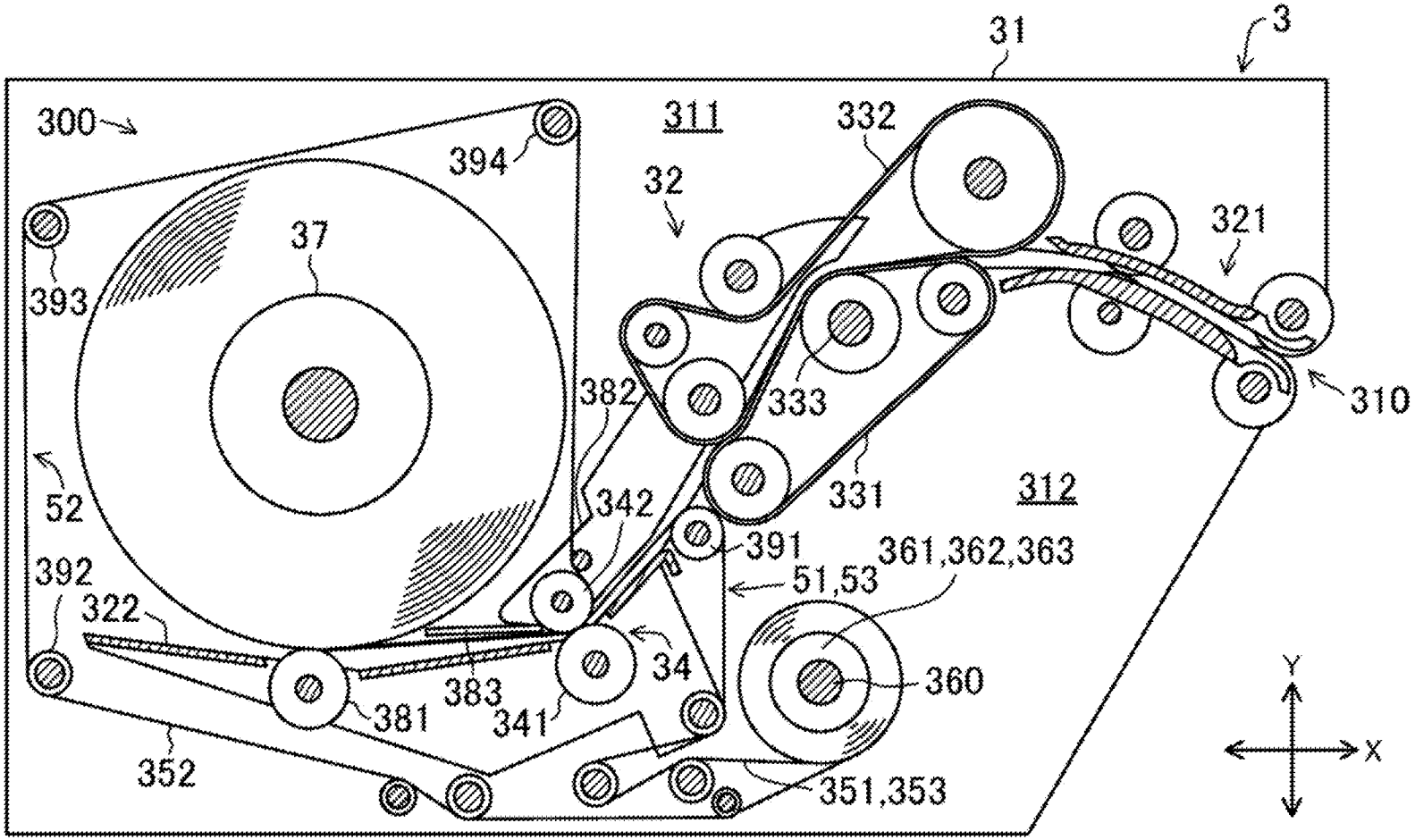
FIG. 4 is a sectional view illustrating a state in which a predetermined amount of banknotes are stored in the banknote storage device shown in FIG. 3.

FIGS. 3 and 4 show an example configuration of the banknote storage device 3. FIG. 3 shows a state where the number of banknotes stored in the banknote storage device 3 is zero (that is, a state where banknotes are not stored in the banknote storage device 3). FIG. 4 shows a state where the banknote storage device 3 stores a predetermined number of banknotes. For convenience of explanation, in the following description, the side-to-side direction in the paper of FIG. 3 is referred to as the X direction; the up-and-down direction in the paper of FIG. 3 is referred to as the Y direction; and the direction orthogonal to the paper of FIG. 3 is referred to as the Z direction.

An inlet/outlet port 310 for depositing and dispensing banknotes is provided on one side surface (right surface in the example of FIG. 3) of the banknote storage device 3. Banknotes enter the banknote storage device 3 through the inlet/outlet port 310 and exit the banknote storage device 3 through the inlet/outlet port 310.

The banknote storage device 3 includes a storing mechanism 300 and a frame 31 accommodating the storing mechanism 300. The storing mechanism 300 is configured to wind up a banknote 100 around a drum 37 together with tapes sandwiching the banknote 100 therebetween (see FIG. 6). The storing mechanism 300 includes a first reel 361, a second reel 362, a third reel 363, the drum 37, and a transport guide 32 that constitutes a transport path for the banknote 100.

The transport guide 32 is disposed inside the frame 31 between the inlet/outlet port 310 and the drum 37. The transport guide 32 extends in the X direction. The transport guide 32 divides the inside of the frame 31 into a first region 311 and a second region 312.

A first tape 351 is wound around the first reel 361 with the base end of the first tape 351 being fixed to the first reel 361. A second tape 352 is wound around the second reel 362 with the base end of the second tape 352 being fixed to the second reel 362. A third tape 353 is wound around the third reel 363 with the base end of the third tape 353 being fixed to the third reel 363. The tip of the first tape 351, the tip of the second tape 352, and the tip of the third tape 353 are fixed to the outer peripheral surface of the drum 37.

Figure 5:
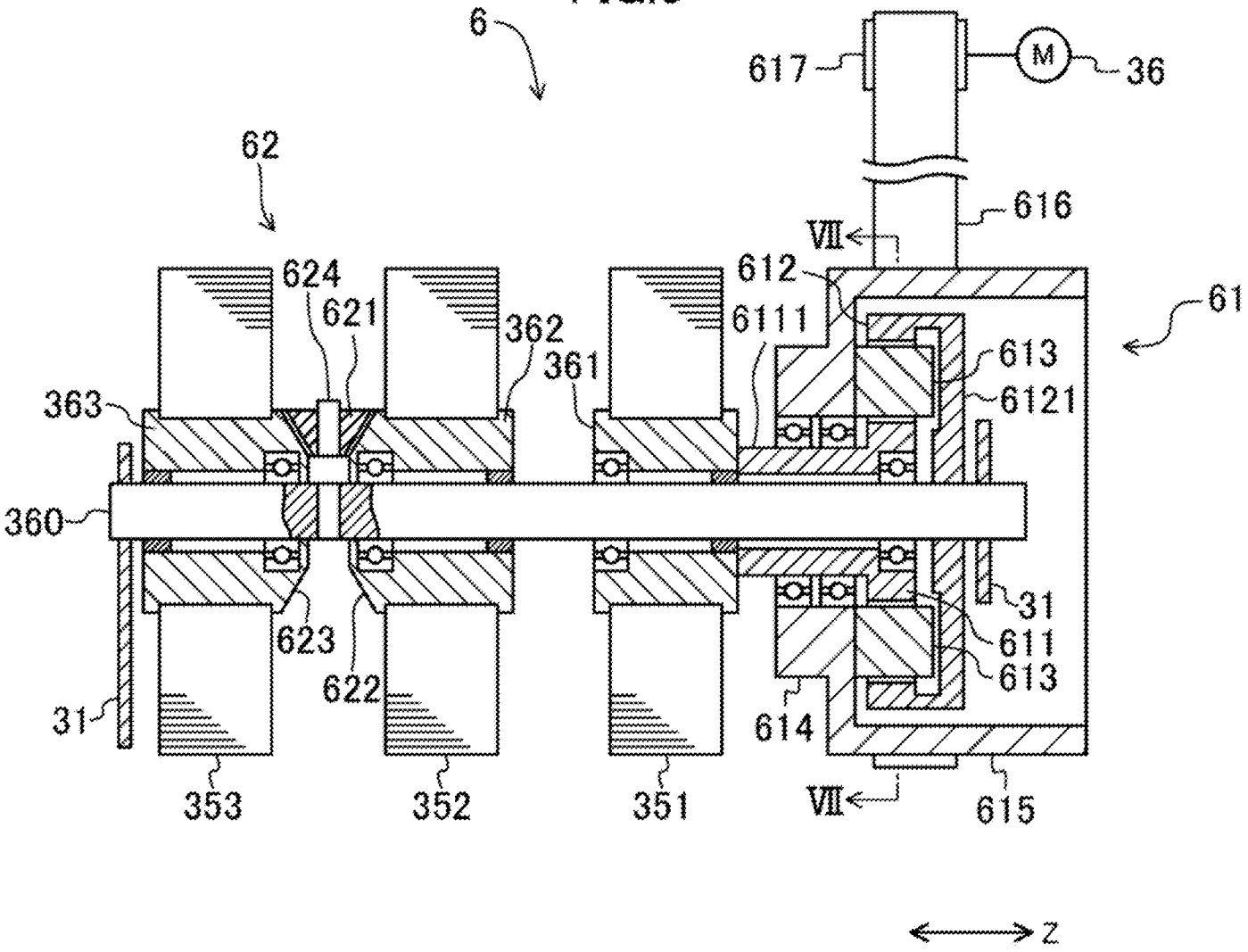
FIG. 5 is a vertical cross-sectional view illustrating a configuration of a torque distribution mechanism.

The first reel 361, the second reel 362, and the third reel 363 are all disposed in the second region 312. The first reel 361, the second reel 362, and the third reel 363 are supported by a shaft 360 extending in the Z direction. Since the first reel 361, the second reel 362, and the third reel 363 are located at the same position in the X direction and the Y direction (that is, the radial direction of the reels), FIGS. 3 and 4 show only one of the reels. As shown in FIG. 5, the first reel 361, the second reel 362, and the third reel 363 are arranged at intervals in order from the right side to the left side in the Z direction.

Both ends of the shaft 360 in the Z direction are rotatably supported by the frames 31, 31 of the banknote storage device 3, respectively.

As shown in FIG. 5, the first reel 361 is attached to the shaft 360 via a bearing. The first reel 361 can rotate independently of the shaft 360. The first reel 361 rotates in the unwinding direction of the first tape 351, that is, in the clockwise direction in FIG. 3, and in the winding direction of the first tape 351, that is, in the counterclockwise direction in FIG. 3, about the shaft 360. The second reel 362 is also attached to the shaft 360 via a bearing. The second reel 362 can rotate independently of the shaft 360. The second reel 362 rotates in the unwinding direction of the second tape 352, that is, in the clockwise direction in FIG. 3, and in the winding direction of the second tape 352, that is, in the counterclockwise direction in FIG. 3, about the shaft 360. The third reel 363 is also attached to the shaft 360 via a bearing. The third reel 363 can also rotate independently of the shaft 360. The third reel 363 rotates in the unwinding direction of the third tape 353, that is, in the clockwise direction in FIG. 3, and in the winding direction of the third tape 353, that is, in the counterclockwise direction in FIG. 3, about the shaft 360.

A torque distribution mechanism 6 that distributes and applies torque from an electric motor 36 to the first reel 361, the second reel 362, and the third reel 363 during rotation of the drum 37 is mounted to the shaft 360. Details of the torque distribution mechanism 6 will be described later.

The transport guide 32 consists of a fixed guide 321 and a movable guide 322. The fixed guide 321 is connected to the inlet/outlet port 310. The fixed guide 321 is comprised of a pair of rollers that sandwich the banknote 100 in its the thickness direction, and a guide member. The fixed guide 321 is configured to transport the banknote 100 toward the drum 37 or toward the outlet/inlet 310.

The movable guide 322 is continuous with the fixed guide 321. The movable guide 322 corresponds to a portion surrounded by the dashed line in FIG. 3. The movable guide 322 is configured to rotate about a rotation shaft 333 of a roller on which a first belt 331 described later is wound. The movable guide 322 is biased in the clockwise direction in FIG. 3 by a biasing member (for example, a spring). The movable guide 322 rotates in the clockwise direction and the counterclockwise direction according to the size of the diameter of the drum 37 described later (see FIGS. 3 and 4). Note that the size of the diameter of the drum 37 described herein means the outermost diameter expanded by the tapes and banknotes if the tapes and banknotes are wound around the drum 37.

The movable guide 322 has a first belt 331 and a second belt 332. The first belt 331 is wound on a plurality of rollers. The second belt 332 is wound on a plurality of rollers, different from those the first belt 331 is wound on. The first belt 331 and the second belt 332 face each other along the transport path of the banknote 100 so as to sandwich the banknote 100 in its thickness direction. The first belt 331 and the second belt 332 are configured to transport the banknote 100 toward the drum 37 or toward the outlet/inlet 310.

The first tape 351 unwound from the first reel 361 runs along a first tape path 51 to reach the drum 37. The second tape 352 unwound from the second reel 362 runs along a second tape path 52 to reach the drum 37. The third tape 353 unwound from the third reel 363 runs along a third tape path 53 to reach the drum 37.

The first tape path 51 is comprised of a movable pulley 391 and a pulley pair 34, which will be described later. The second tape path 52 is comprised of guide pulleys 392, 393, and 394 and a pulley pair 34, which will be described later. The third tape path 53 is comprised of a movable pulley 391 and a pulley pair 34. The first tape path 51 and the third tape path 53 are at the same position in the X direction and the Y direction, and are displaced from each other in the Z direction. Therefore, in FIGS. 3 and 4, the first tape path 51 and the third tape path 53 overlap each other. Two movable pulleys 391 are provided in the Z direction so as to be associated with the first tape 351 and the third tape 353. Three pulley pairs 34 are provided in the Z direction so as to be associated with the first tape 351, the second tape 352, and the third tape 353 (see also FIG. 6).

A communication portion 323 communicating the first region 311 with the second region 312 is provided at an intermediate portion of the movable guide 322. The movable pulleys 391 for guiding the first tape 351 and the third tape 353, respectively, are provided in the communication portion 323. The movable pulleys 391 rotate about the rotation shaft 333 together with the movable guide 322.

The pulley pair 34 is disposed at the end of the transport path provided in the movable guide 322. The pulley pair 34 is comprised of a first pulley 341 and a second pulley 342. The first pulley 341 and the second pulley 342 are disposed so as to face each other. The first pulleys 341 and the second pulleys 342 guide the first tape 351, the second tape 352, and the third tape 353 toward the outer peripheral surface of the drum 37, as will be described later.

The first tape 351 reaches the pulley pair 34 via the movable pulley 391. The first tape 351 runs along the transport path of the banknote 100 between the movable pulley 391 and the pulley pair 34. Similarly, the third tape 353 reaches the pulley pair 34 via the movable pulley 391. The third tape 353 runs along the transport path of the banknote 100 between the movable pulley 391 and the pulley pair 34.

The second tape 352 unwound from the second reel 362 is guided to the first region 311 so as to bypass the movable guide 322. The second tape path 52 is provided so as to surround the periphery of the drum 37. The second tape path 52 is comprised of a plurality of guide pulleys. In the example configuration shown in FIG. 3, the guide pulleys include a first guide pulley 392, a second guide pulley 393, and a third guide pulley 394.

In the example configuration shown in FIG. 3, the first guide pulley 392 is disposed in the second region 312 near the lower left corner of the paper of FIG. 3. The first guide pulley 392 changes the running direction of the second tape 352 from substantially the X direction to the Y direction.

In the example configuration shown in FIG. 3, the second guide pulley 393 is disposed in the first region 311 near the upper left corner of the paper of FIG. 3. The second guide pulley 393 changes the running direction of the second tape 352 from the Y direction to substantially the X direction.

In the example configuration shown in FIG. 3, the third guide pulley 394 is disposed in the upper part of the first region 311 near the central position in the X direction. The third guide pulley 394 changes the running direction of the second tape 352 from substantially the X direction to the Y direction.

After being wound on the third guide pulley 394, the second tape 352 reaches the aforementioned pulley pair 34. The pulley pair 34 guides the second tape 352 toward the outer peripheral surface of the drum 37.

A pressing roller 381 is attached to a distal end portion of the movable guide 322. The pressing roller 381 abuts on the first tape 351 and the third tape 353 which are wound around the drum 37. The pressing roller 381 presses the first tape 351 and the third tape 353. Associated with the turning of the movable guide 322, the pressing roller 381 changes its relative position with respect to the center of the drum 37. The position of the pressing roller 381 changes in accordance with the size of the diameter of the drum 37.

The drum 37 is disposed in the first region 311. Specifically, the drum 37 is disposed in the first region 311 at a position away from the outlet/inlet 310.

Figure 6:
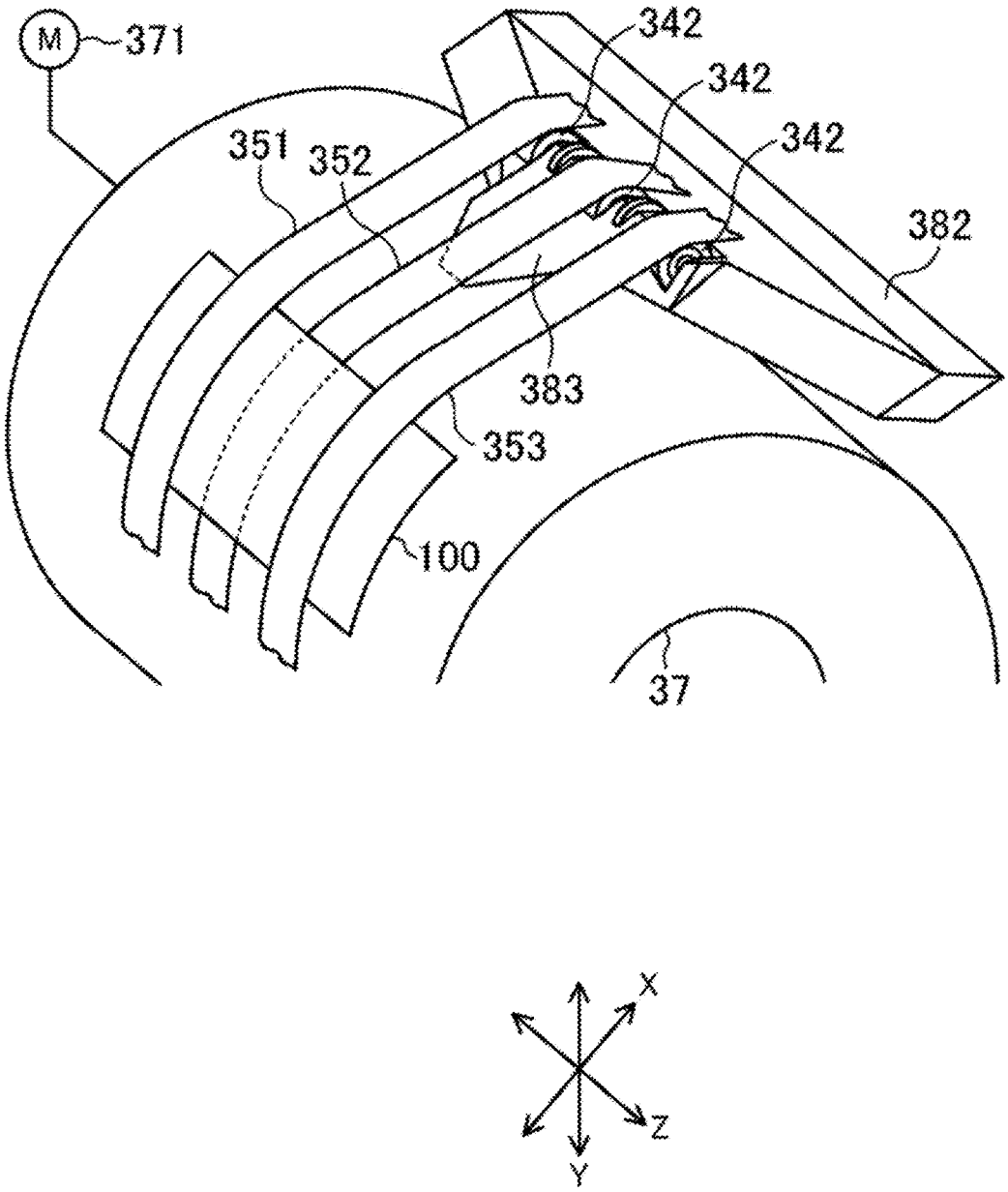
FIG. 6 is a perspective view illustrating a state in which a banknote and tapes are wound around a drum.

The drum 37 rotates about an axis extending in the Z direction. The axis of the drum 37 and the shaft 360 are parallel to each other. The drum 37 rotates in the winding direction of the banknote 100 and the tapes, and in the feeding direction of the banknote 100 and the tapes. In the example of FIG. 3, the winding direction of the banknote 100 and the tapes is the clockwise direction, and the feeding direction of the banknote 100 and the tapes is the counterclockwise direction. As shown in FIG. 6, an electric motor 371 for rotating the drum 37 is connected to the drum 37. The electric motor 371 may be, for example, a stepper motor. Note that FIG. 6 depicts the drum 37 and a guide plate 382 provided on the movable guide 322 by inverting them shown in FIGS. 3 and 4. Three second pulleys 342 forming the pulley pairs 34 are attached to the guide plate 382 so as to be associated with the running positions of the first tape 351, the second tape 352, and the third tape 353.

As shown in FIG. 6, the first tape 351 and the third tape 353 are located at both ends in the longitudinal direction of the banknote 100 transported with the long edge in front. The first tape 351 and the third tape 353 are located above the banknote 100. That is, when wound around the drum 37, the first tape 351 and the third tape 353 are located radially outside the banknote 100.

The second tape 352 is located at the center of the banknote 100 in the longitudinal direction. The second tape 352 is located below the banknote 100. That is, when wound around the drum 37, the second tape 352 is located radially inside the banknote 100.

The banknote 100 is sandwiched between the first tape 351, the second tape 352, and the third tape 353 at the position of the pulley pairs 34. The banknote 100 is wound around the outer peripheral surface of the drum 37 together with the first tape 351, the second tape 352, and the third tape 353.

The banknote storage device 3 winds up the banknote 100, the first tape 351, the second tape 352, and the third tape 353 around the drum 37 with the banknote 100 being held by the first tape 351, the second tape 352, and the third tape 353, thereby achieving stable winding of the banknote 100 around the drum 37. Further, since the second tape 352 is located below the banknote 100, the banknote 100 can be reliably released from the drum 37 when the banknote 100 and the second tape 352 are fed out from the drum 37. Further, since the storing mechanism 300 configured as described above presses both end parts and the central part of the banknote 100 in the longitudinal direction with three tapes, the banknote 100 can be stably wound around the drum 37.

(Configuration of Torque Distribution Mechanism)

In the banknote storage device 3 configured as described above, two electric motors, namely, the electric motor 371 for rotating the drum 37 and the electric motor 36 for applying torque to the reels, are controlled so that predetermined tensions are generated on the tapes when the banknote 100 and the tapes are wound up around the drum 37 or fed out from the drum 37 during the rotation of the drum 37. The torque distribution mechanism 6 distributes the torque from the electric motor 36, which is a torque source, to the first reel 361, the second reel 362, and the third reel 363.

As described above, the three tapes, namely, the first tape 351, the second tape 352, and the third tape 353, are aligned in the axial direction of the drum 37 and hold a plurality of positions of the banknote. Here, when the diameter of the drum 37 around which the banknote 100 is wound up together with the tapes becomes large, the size of the diameter of the drum 37 may be non-uniform in the axial direction of the drum 37. If the size of the diameter of the drum 37 is non-uniform in the axial direction, the winding speeds or the feeding speeds of the tapes during rotation of the drum 37 differ among the three tapes arranged in the axial direction. Therefore, tensions generated on the tapes are unequal among the three tapes. If the tensions generated on the tapes are unequal, the banknote 100 wound up on the drum 37 will be displaced.

Figure 7:
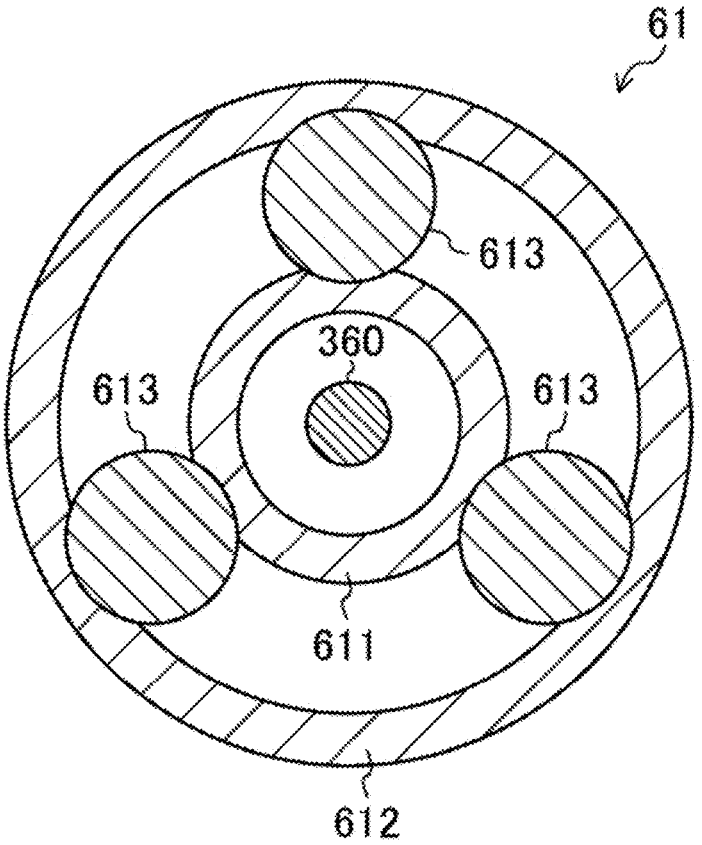
FIG. 7 is a sectional view, taken along line VII-VII in FIG. 5, illustrating a configuration of a first differential mechanism.
Figure 8:
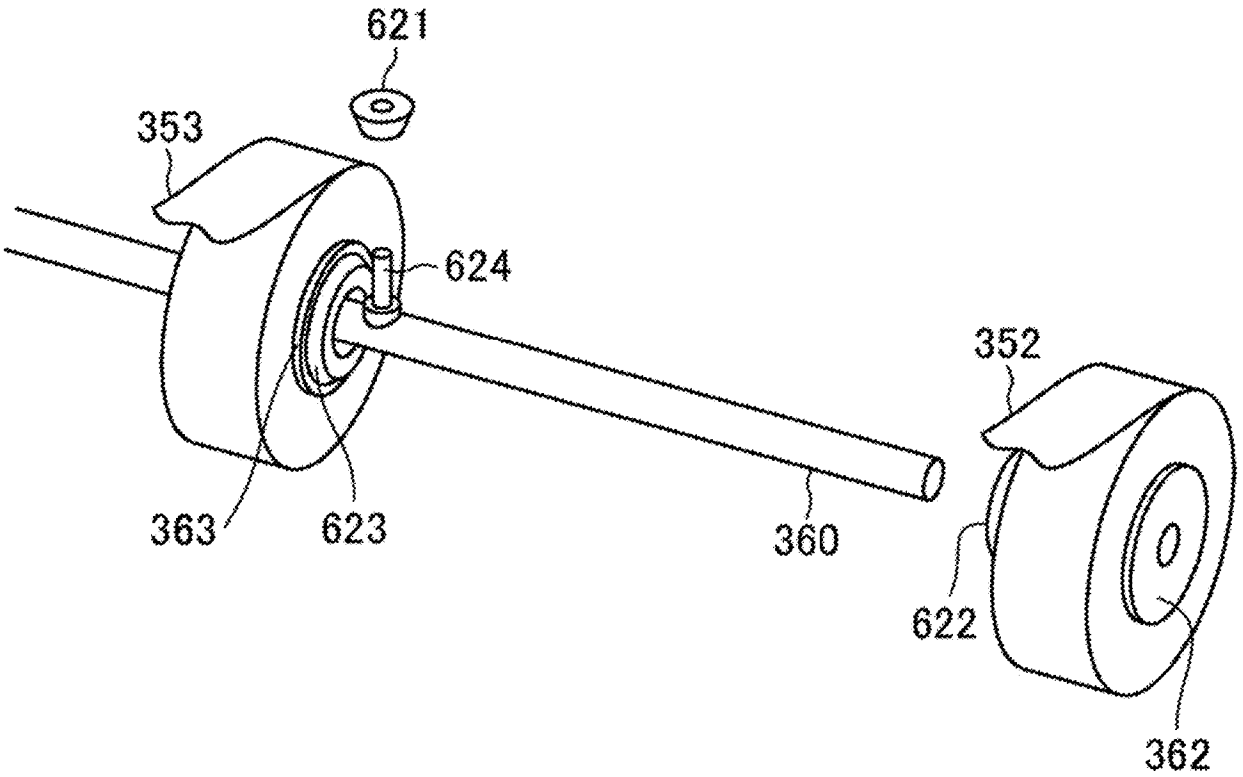
FIG. 8 is an exploded perspective view illustrating a configuration of a second differential mechanism.

The torque distribution mechanism 6 has a function of absorbing the speed difference among the three tapes and making adjustment so that the three tapes, namely, the first tape 351, the second tape 352, and the third tape 353, constantly have a predetermined tension. The configuration of the torque distribution mechanism 6 will be described below with reference to FIGS. 5, 7, and 8. FIG. 5 is a vertical cross-sectional view of the shaft 360 provided with the torque distribution mechanism 6, FIG. 7 is a transverse sectional view (taken along line VII-VII in FIG. 5) of a planetary gear mechanism included in a later-described first differential mechanism 61, and FIG. 8 is an exploded perspective view of a second differential mechanism 62.

The torque distribution mechanism 6 has the first differential mechanism 61 and the second differential mechanism 62. The first differential mechanism 61 includes a planetary gear mechanism. The second differential mechanism 62 includes a bevel gear.

The first differential mechanism 61 is disposed at one end (the right end of the paper in FIG. 5) of the shaft 360 extending in the Z direction. The first differential mechanism 61 includes a sun gear 611, a ring gear 612, a planetary gear 613, and a carrier 614.

The sun gear 611 is fitted onto the shaft 360. The sun gear 611 is supported by the shaft 360 via a bearing. Teeth are formed on the outer peripheral surface of the sun gear 611. The sun gear 611 has a pipe 6111 formed integrally with the sun gear 611. The pipe 6111 is fitted onto the shaft 360 and extends along the shaft 360. The tip of the pipe 6111 is fixed to the side surface of the first reel 361. The sun gear 611 and the first reel 361 rotate integrally. The sun gear 611 and the first reel 361 rotate relative to the shaft 360.

As shown in FIG. 7, the ring gear 612 is provided so as to surround the outer circumference of the sun gear 611. Teeth are formed on the inner peripheral surface of the ring gear 612. The ring gear 612 is fixed to the shaft 360. More specifically, the ring gear 612 is integrally provided with a disk-shaped connection member 6121 extending in the radial direction around the shaft 360. The connection member 6121 is fixed to the shaft 360. The ring gear 612 and the shaft 360 rotate integrally.

The planetary gear 613 is disposed between the sun gear 611 and the ring gear 612 as shown in FIG. 7. In this example configuration, three planetary gears 613 are arranged at equal intervals in the circumferential direction. Each of the planetary gears 613 has teeth formed on its outer peripheral surface. The planetary gears 613 mesh with each of the sun gear 611 and the ring gear 612.

The carrier 614 supports the planetary gears 613 in such a way that the planetary gears 613 can rotate. The carrier 614 is also supported by the pipe 6111 of the sun gear 611 via a bearing. The carrier 614 rotates about the shaft 360 relative to the shaft 360, the sun gear 611, and the ring gear 612. The planetary gears 613 supported by the carrier 614 rotate and revolve around the shaft 360.

A driven roller 615 is integrally attached to the carrier 614. The driven roller 615 is formed in a cylindrical shape so as to cover the planetary gear mechanism. A belt 616 is wound on the driven roller 615. The belt 616 is wound on a drive roller 617 attached to the rotation shaft of the electric motor 36. When the electric motor 36 as a torque source rotates, the torque of the electric motor 36 is transmitted to the driven roller 615 via the belt 616. In this way, the torque of the electric motor 36 is input to the carrier 614.

The first differential mechanism 61 transmits the torque input to the carrier 614 to the first reel 361 via the sun gear 611 and to the shaft 360 via the ring gear 612. The first differential mechanism 61 distributes the torque input from the torque source to a first path and a second path. The first path is a path for transmitting torque to the first reel 361 via the sun gear 611. The second path is a path for transmitting torque to the shaft 360 (and the second reel 362 and the third reel 363 supported by the shaft 360) via the ring gear 612.

Here, the torque distributed by the first differential mechanism 61 can be transmitted to the first reel 361, the second reel 362, and the third reel 363 through the shaft 360 and the pipe 6111 having a double tube structure. The torque transmission path becomes compact.

In the first differential mechanism 61, the gear ratio between the sun gear 611 and the ring gear 612 (that is, the number of teeth of the sun gear 611/the number of teeth of the ring gear 612) is set to 1/2. As an example, the sun gear 611 may have 30 teeth, the ring gear 612 may have 60 teeth, and each of the planetary gears 613 may have 15 teeth. Since the gear ratio is set to 1/2, the first differential mechanism 61 can transmit ⅓ (=1/(1+2))T of the torque T input to the carrier 614 to the first reel 361, and ⅔ (=2/(1+2))T of the torque T to the shaft 360.

The second differential mechanism 62 is provided between the second reel 362 and the third reel 363. The second differential mechanism 62 has a pinion gear 621 and two side gears, a first side gear 622 and a second side gear 623.

A pin 624 is attached to the shaft 360, as also shown in FIG. 8. The pin 624 projects radially outward of the shaft 360 between the second reel 362 and the third reel 363. The pin 624 is perpendicular to the shaft 360. The pin 624 rotates with the shaft 360.

The pinion gear 621 is a bevel gear. The pinion gear 621 is rotatably supported by the pin 624. The pinion gear 621 spins around the pin 624, and when the shaft 360 rotates, it revolves around the shaft 360.

The first side gear 622 is formed on the side surface of the second reel 362. The first side gear 622 is a bevel gear centered on the shaft 360. The first side gear 622 meshes with the pinion gear 621.

The second side gear 623 is formed on the side surface of the third reel 363. The second side gear 623 and the first side gear 622 face each other. The second side gear 623 is a bevel gear centered on the shaft 360. The second side gear 623 meshes with the pinion gear 621. The number of teeth of the first side gear 622 and the number of teeth of the second side gear 623 are the same.

The second differential mechanism 62 equally distributes the torque input to the shaft 360 to the second reel 362 and the third reel 363 via the pinion gear 621, the first side gear 622, and the second side gear 623. The path from the pinion gear 621 to the second reel 362 via the first side gear 622 corresponds to a third path. The path from the pinion gear 621 to the third reel 363 via the second side gear 623 corresponds to a fourth path.

As described above, the torque input to the shaft 360 is ⅔T of the torque T of the electric motor 36. Therefore, the second differential mechanism 62 transmits ⅓(=⅔×½)T of the torque T from the electric motor 36 to the second reel 362 and ⅓(=⅔×½)T of the torque T from the electric motor 36 to the third reel 363. Therefore, the first differential mechanism 61 and the second differential mechanism 62 equally distribute the torque of the electric motor 36 to the first reel 361, the second reel 362, and the third reel 363 in cooperation with each other.

As described above, when a speed difference occurs among the first tape 351, the second tape 352, and the third tape 353 due to the size of the diameter of the drum 37 being non-uniform, the first differential mechanism 61 and the second differential mechanism 62 each perform a differential operation to absorb the speed difference. The differential operations of the first differential mechanism and the second differential mechanism will be described below with reference to FIGS. 9 to 14. FIGS. 9 to 14 schematically illustrate the configuration of the torque distribution mechanism 6. FIGS. 9 to 14 illustrate various combinations of speeds of the three tapes, respectively.

Figure 9:
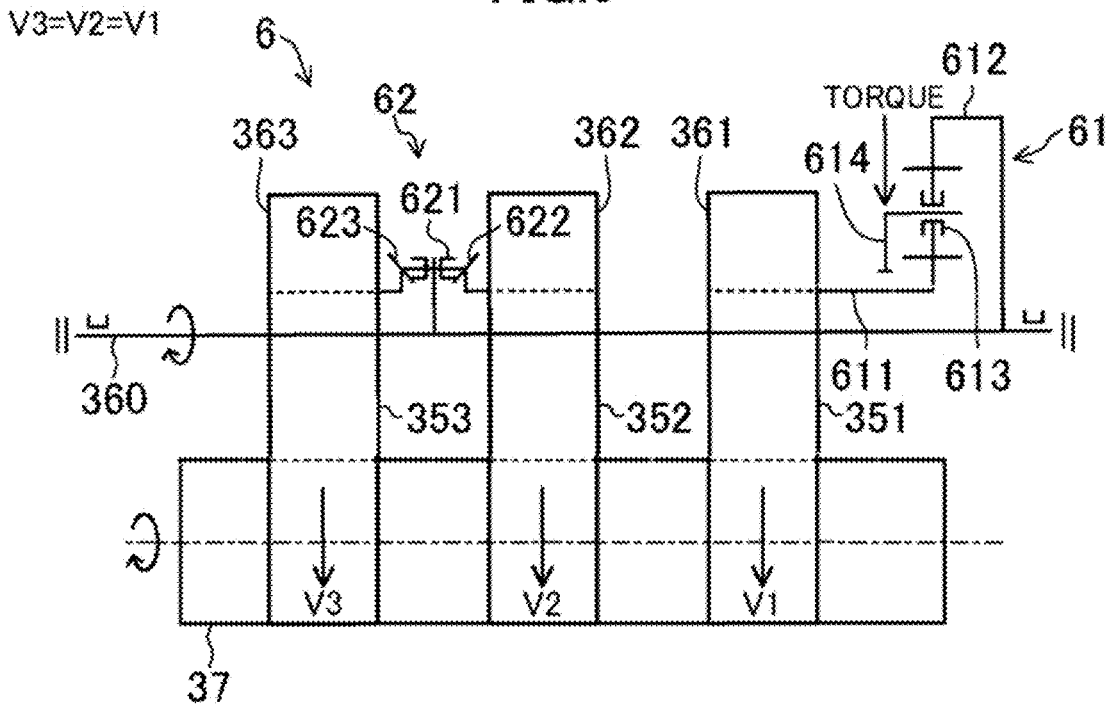
FIG. 9 is an explanatory diagram showing operations of the first differential mechanism and the second differential mechanism when a first tape, a second tape, and a third tape move at equal speed (V3=V2=V1).

FIG. 9 illustrates a state where the diameter of the drum 37 is uniform or substantially uniform in the Z direction, and the speed V1 of the first tape 351, the speed V2 of the second tape 352, and the speed V3 of the third tape 353 are equal or substantially equal (V3=V2=V1).

When V3=V2=V1, the first reel 361, the second reel 362, the third reel 363, and the shaft 360 rotate at equal speed. Therefore, in the first differential mechanism 61, the planetary gears 613 do not rotate. The sun gear 611, the ring gear 612, and the carrier 614 rotate at equal speed.

Further, in the second differential mechanism 62, the pinion gear 621 does not rotate. Therefore, the first side gear 622 and the second side gear 623 rotate at equal speed, and the pinion gear 621 also revolves at equal speed.

Therefore, when V3=V2=V1, a predetermined tension is generated on each of the first tape 351, the second tape 352, and the third tape 353, which prevents or reduces displacement of the banknote 100.

Figure 10:
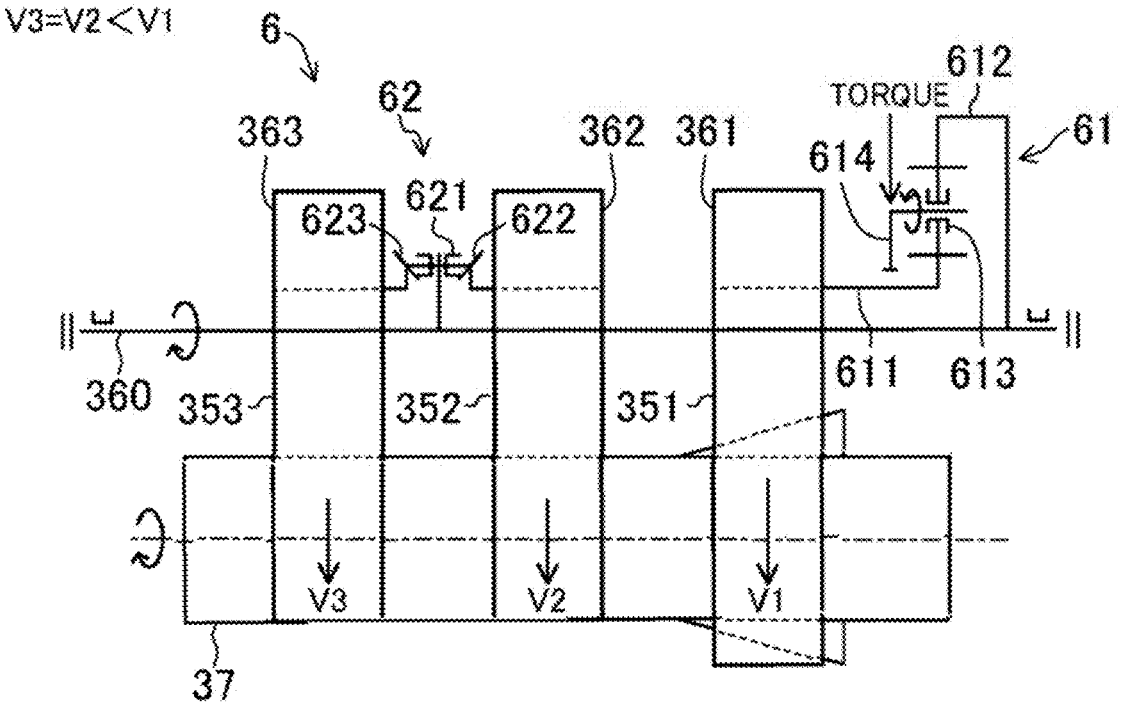
FIG. 10 is an explanatory diagram showing operations of the first differential mechanism and the second differential mechanism when the first tape, the second tape, and the third tape do not move at equal speed (V3=V2<V1).

FIG. 10 shows a state where the diameter of the drum 37 is non-uniform in the Z direction, so that the speed V2 of the second tape 352 and the speed V3 of the third tape 353 are equal, and the speed V1 of the first tape 351 is higher than the speeds V2 and V3 (V3=V2<V1). As schematically shown in FIG. 10, if the diameter of the drum 37 is large only at the portion corresponding to the first tape 351, the speed V1 of the first tape 351, the speed V2 of the second tape 352, and the speed V3 of the third tape 353 have the abovementioned relationship.

Since V3=V2, the pinion gear 621 does not rotate in the second differential mechanism 62 as described above. The first side gear 622 and the second side gear 623 rotate at equal speed, and the pinion gear 621 also revolves at equal speed.

Since the speed of the first tape 351 is higher, the rotation speed of the first reel 361 is relatively higher. There is a speed difference between the sun gear 611 of the first differential mechanism 61 and the shaft 360. In the first differential mechanism 61, the planetary gears 613 rotate because a speed difference occurs between the sun gear 611 and the ring gear 612. The planetary gears 613 rotate in the direction in which the sun gear 611 accelerates. In this way, the first differential mechanism 61 absorbs the speed difference among the first tape 351, the second tape 352, and the third tape 353, and thus can generate a predetermined tension on each of the first tape 351, the second tape 352, and the third tape 353 when V3=V2<V1.

Figure 11:
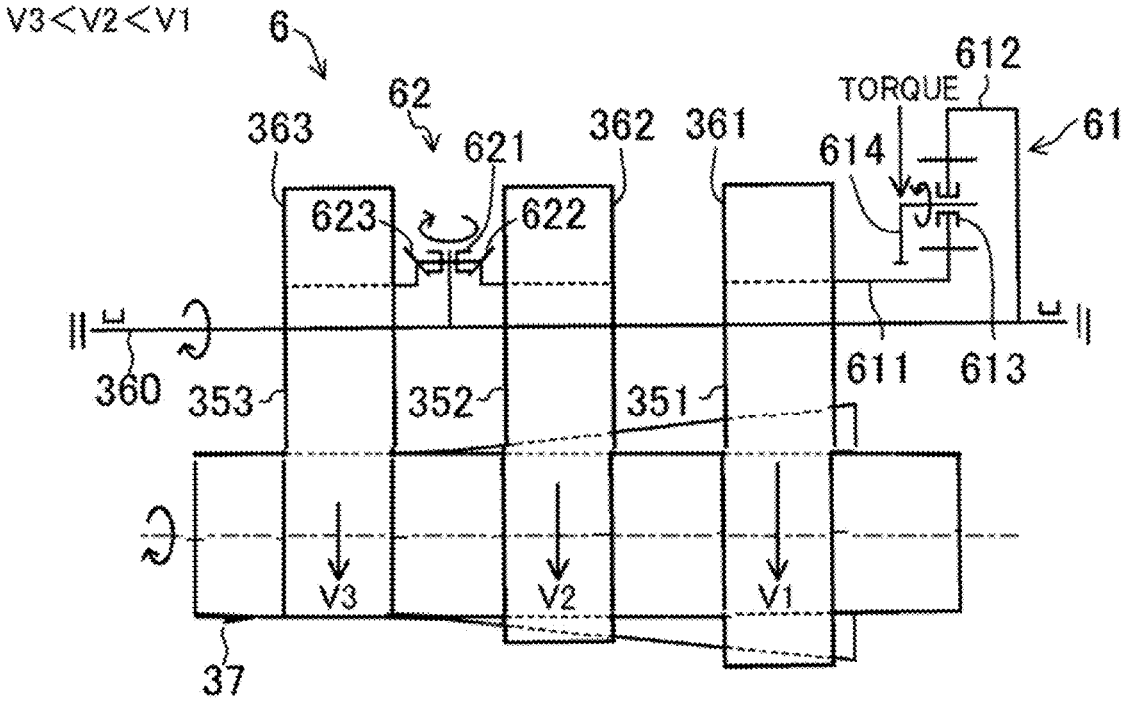
FIG. 11 is an explanatory diagram showing operations of the first differential mechanism and the second differential mechanism when the first tape, the second tape, and the third tape do not move at equal speed (V3<V2<V1).

FIG. 11 shows a state where the diameter of the drum 37 is non-uniform in the Z direction, and the speed V1 of the first tape 351, the speed V2 of the second tape 352, and the speed V3 of the third tape 353 are different from one another (V3<V2<V1). As schematically shown in FIG. 11, when the diameter of the drum 37 gradually increases in the direction from the third tape 353 to the first tape 351, the speed V1 of the first tape 351, the speed V2 of the second tape 352, and the speed V3 of the third tape 353 have the abovementioned relationship.

Since V3<V2, the pinion gear 621 of the second differential mechanism 62 rotates, unlike the above case. The pinion gear 621 rotates in the direction in which the first side gear 622 accelerates, and absorbs the speed difference between the second reel 362 and the third reel 363.

Further, also in the first differential mechanism 61, the sun gear 611 and the shaft 360 rotate relative to each other. The planetary gears 613 rotate in the direction in which the sun gear 611 accelerates. The rotation of the planetary gears 613 absorbs the speed difference between the sun gear 611 and the ring gear 612. In this way, the first differential mechanism 61 and the second differential mechanism 62 absorb the speed difference among the first tape 351, the second tape 352, and the third tape 353, and thus can generate a predetermined tension on each of the first tape 351, the second tape 352, and the third tape 353 when V3<V2<V1.

Figure 12:
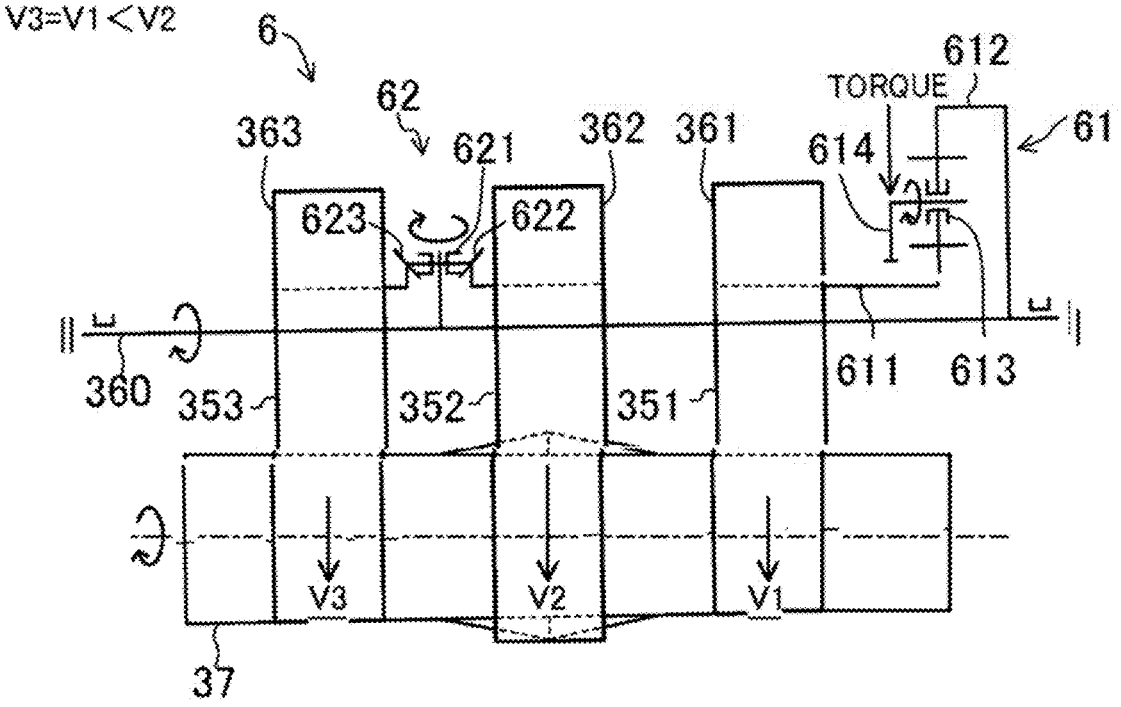
FIG. 12 is an explanatory diagram showing operations of the first differential mechanism and the second differential mechanism when the first tape, the second tape, and the third tape do not move at equal speed (V3=V1<V2).

FIG. 12 shows a state where the diameter of the drum 37 is non-uniform in the Z direction, so that the speed V1 of the first tape 351 and the speed V3 of the third tape 353 are equal, and the speed V2 of the second tape 352 is higher than the speeds V1 and V3 (V3=V1<V2). As schematically shown in FIG. 12, if the diameter of the drum 37 is large only at the position corresponding to the second tape 352, the speed V1 of the first tape 351, the speed V2 of the second tape 352, and the speed V3 of the third tape 353 have the abovementioned relationship.

Since V3<V2, the pinion gear 621 of the second differential mechanism 62 rotates in the direction in which the first side gear 622 accelerates to absorb the speed difference between the second reel 362 and the third reel 363.

Further, in the first differential mechanism 61, the planetary gears 613 rotate in the direction in which the ring gear 612 accelerates. In this way, the speed difference between the sun gear 611 and the ring gear 612 is absorbed. When V3=V1<V2, the first differential mechanism 61 and the second differential mechanism 62 absorb the speed difference among the first tape 351, the second tape 352, and the third tape 353, and thus can generate a predetermined tension on each of the first tape 351, the second tape 352, and the third tape 353.

Figure 13:
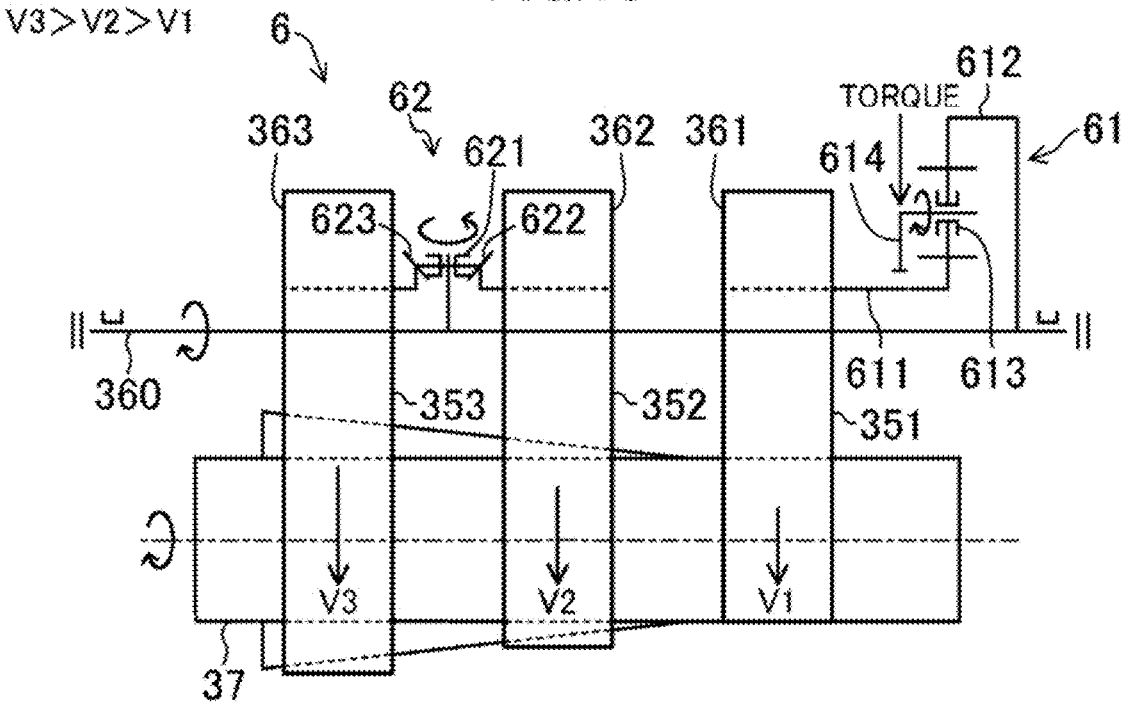
FIG. 13 is an explanatory diagram showing operations of the first differential mechanism and the second differential mechanism when the first tape, the second tape, and the third tape do not move at equal speed (V3>V2>V1).

FIG. 13 shows a state where the diameter of the drum 37 is non-uniform in the Z direction, and the speed V1 of the first tape 351, the speed V2 of the second tape 352, and the speed V3 of the third tape 353 are different from one another (V3>V2>V1). As schematically shown in FIG. 13, when the diameter of the drum 37 gradually decreases in the direction from the third tape 353 to the first tape 351, the speed V1 of the first tape 351, the speed V2 of the second tape 352, and the speed V3 of the third tape 353 have the abovementioned relationship.

Since V3>V2, the pinion gear 621 in the second differential mechanism 62 rotates in the direction in which the second side gear 623 accelerates to absorb the speed difference between the second reel 362 and the third reel 363.

Further, in the first differential mechanism 61, the planetary gears 613 rotate in the direction in which the ring gear 612 accelerates, thereby absorbing the speed difference between the sun gear 611 and the ring gear 612. In this way, the first differential mechanism 61 and the second differential mechanism 62 absorb the speed difference among the first tape 351, the second tape 352, and the third tape 353, and thus can generate a predetermined tension on each of the first tape 351, the second tape 352, and the third tape 353 when V3>V2>V1.

Figure 14:
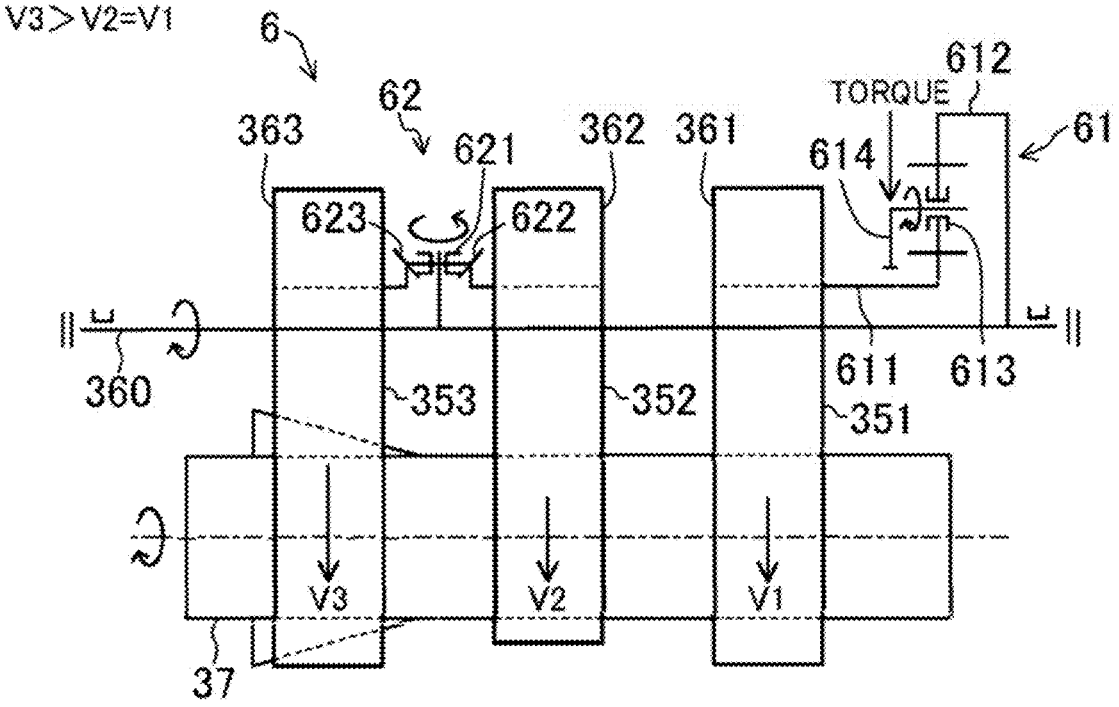
FIG. 14 is an explanatory diagram showing operations of the first differential mechanism and the second differential mechanism when the first tape, the second tape, and the third tape do not move at equal speed (V3>V2=V1).

FIG. 14 shows a state where the diameter of the drum 37 is non-uniform in the Z direction, so that the speed V1 of the first tape 351 and the speed V2 of the second tape 352 are equal, and the speed V3 of the third tape 353 is higher than the speeds V1 and V2 (V3>V2=V1). As schematically shown in FIG. 14, if the diameter of the drum 37 is large only at the position corresponding to the third tape 353, the speed V1 of the first tape 351, the speed V2 of the second tape 352, and the speed V3 of the third tape 353 have the abovementioned relationship.

Since V3>V2, the pinion gear 621 in the second differential mechanism 62 rotates in the direction in which the second side gear 623 accelerates to absorb the speed difference between the second reel 362 and the third reel 363.

Further, in the first differential mechanism 61, the planetary gears 613 rotate in the direction in which the ring gear 612 accelerates, thereby absorbing the speed difference between the sun gear 611 and the ring gear 612. In this way, the first differential mechanism 61 and the second differential mechanism 62 absorb the speed difference among the first tape 351, the second tape 352, and the third tape 353, and thus can generate a predetermined tension on each of the first tape 351, the second tape 352, and the third tape 353 when V3>V2=V1.

As described above, when the speeds of the three tapes are unequal or about to be unequal, the first differential mechanism 61 and the second differential mechanism 62 each perform differential operations for absorbing the speed difference. The tensions generated on the three tapes are constantly equal or substantially equal. The banknote storage device 3 does not require a torque limiter.

By equalizing or substantially equalizing the tensions generated on the three tapes, it is possible to prevent or reduce the displacement of the banknote 100 wound around the drum 37. As a result, it is possible to prevent or reduce an occurrence of a jam of the banknote 100 in the banknote storage device 3. When a jam occurs in the banknote storage device 3, the jam is often eliminated by cutting the tapes. In this case, the unit in the banknote storage device 3 needs to be replaced. Suppressing or reducing the jam of the banknote 100 in the banknote storage device 3 by the torque distribution mechanism 6 as described above is advantageous in reducing cost.

Further, since the speed difference among the three tapes is automatically absorbed by the first differential mechanism 61 and the second differential mechanism 62 that are mechanically configured, the torque distribution mechanism 6 can optimally adjust the torque to be applied to the three reels only by controlling the electric motor 371 for the drum 37 and the electric motor 36 for the reels. The torque distribution mechanism 6 having the above configuration can simplify the configuration of a control system.

(Configuration of Flexible Guide)

A flexible guide 383 is attached to the banknote storage device 3 shown in FIG. 3. The flexible guide 383 has a function of preventing or reducing a jam of the banknote 100 by guiding the banknote 100 to the transport path of the transport guide 32 when the tapes and the banknote 100 are fed out from the drum 37. The flexible guide 383 is attached to the guide plate 382 provided on the movable guide 322.

As shown in FIG. 6, the guide plate 382 is inclined such that the tip part approaches the drum 37 from both sides toward the center in the Z direction. The tip part of the guide plate 382 has a substantially triangular shape in a plan view. The flexible guide 383 is attached to the tip part of the guide plate 382 at a position corresponding to the vertex of the triangle. The mounting position of the flexible guide 383 corresponds to the running position of the second tape 352. The flexible guide 383 also has a triangular shape like the tip part of the guide plate 382. The bottom part of the flexible guide 383 is fixed near the inlet of the transport path of the guide plate 382. The vertex of the flexible guide 383 is arranged so as to approach the drum 37. The two hypotenuses of the flexible guide 383 are inclined away from the second tape 352 from the vertex near the drum toward the inlet of the transport path of the guide plate 382.

When the banknote 100 is fed out from the drum 37, the second tape 352 is located between the banknote 100 and the drum 37, and the central portion of the banknote 100 in contact with the second tape 352 is reliably guided to the transport path of the guide plate 382. When the banknote 100 is fed out from the drum 37, the first tape 351 and the third tape 353 are on the outside of the banknote with respect to the drum 37. The banknote may have a curl, and both ends of the banknote fed out from the drum 37 in the longitudinal direction may be curved in the direction approaching the drum 37. Further, when the guide plate 382 is on the drum 37, both ends of the banknote fed out from the drum 37 in the longitudinal direction may be curved in the direction approaching the drum 37 due to gravity. The curved portion abuts on one of the two hypotenuses of the flexible guide 383 and is gradually guided to the transport path of the guide plate 382 as it advances in the direction in which the banknote is fed out from the drum 37.

The flexible guide 383 is a thin plate-shaped member, and is made of a soft material that is flexible. The flexible guide 383 is attached so as to project from the guide plate 382 toward the drum 37. The flexible guide 383 is thin, so that it can be provided near the drum 37 without interfering with the drum 37 (see also FIGS. 3 and 4). The closer the vertex of the flexible guide 383 is to the drum 37, the more the distance between the vertex and the base of the flexible guide 383 can be increased, and the angle of the vertex can be reduced. Accordingly, the angle at which the two hypotenuses of the flexible guide 383 are inclined in the direction away from the second tape 352 can be reduced. As a result, the curl of the banknote can be gradually corrected, so that damage or jam of the banknote can be prevented or reduced.

When the banknote storage device 3 is configured to have a large capacity, the diameter of the drum 37 around which the banknote 100 is wound becomes large. In order to secure the space of the drum 37 inside the banknote storage device 3, the distance between the central axis of the drum 37 and the position of the pulley pairs 34 needs to be increased. As a result, the tip of the guide plate 382 is separated from the outer peripheral surface of the drum 37. If the tip of the guide plate 382 is separated from the outer peripheral surface of the drum 37, the distance of the curved portion of the banknote 100 moving without being guided by the flexible guide 383 is increased between the drum 37 and the guide plate 382 when the banknote 100 and the tapes are fed out from the drum 37. Therefore, the curved portion of the banknote 100 is corrected in a short distance, so that it is highly likely that the banknote 100 is damaged. However, as described above, the tip of the rigid guide plate 382 cannot be brought closer to the drum 37 in order to avoid interference with the drum 37.

Since the flexible guide 383 is thinner than the guide plate 382, it can be placed near the drum 37 without interfering with the drum 37 as described above. Further, since the flexible guide 383 can be bent, it comes in contact with the second tape 352 and the banknote 100 unwound from the drum 37 and can be deformed along the direction of the second tape 352 and the banknote 100. Therefore, the flexible guide 383 can be placed closer to the drum 37 while avoiding interference with the drum. As a result, the flexible guide 383 can guide the banknote 100 near the drum 37.

Figure 15:
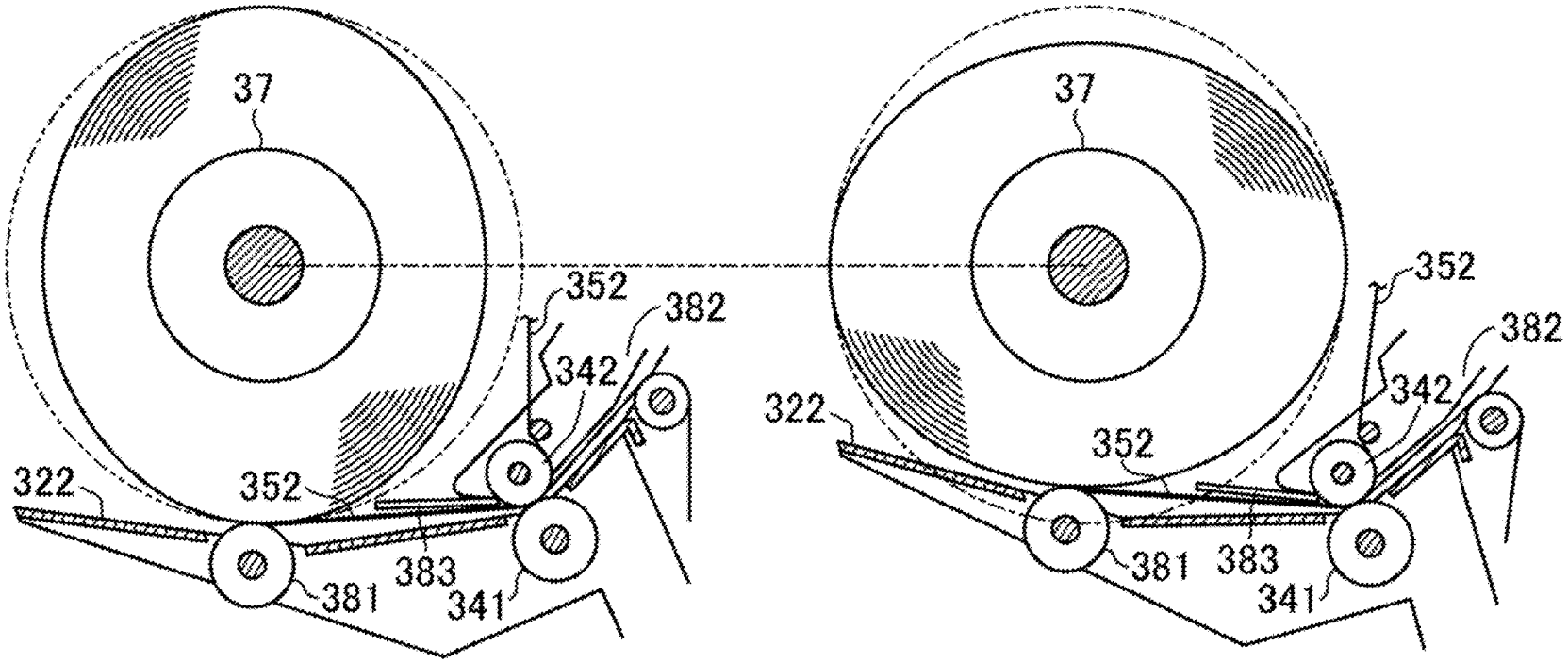
FIG. 15 is a side view illustrating a positional relationship between the drum and a flexible guide when the outer shape of the drum is different.

Further, as illustrated on the right and left of FIG. 15, the drum 37 around which the banknote 100 and the tapes are wound may have an elliptical shape instead of a perfect circular shape. If the drum 37 has an elliptical shape, the radial position (distance between the center of the drum 37 and the pressing roller 381) where the pressing roller 381 abuts on the outer peripheral surface of the drum 37 during rotation of the drum 37 changes, so that the angle of the movable guide 322 varies. Since the flexible guide 383 deforms along the direction of the second tape 352 unwound from the drum 37 even if the angle of the movable guide 322 varies, the flexible guide 383 can guide the banknote 100 at the same angle with respect to the second tape 352 and the banknote 100 which are unwound from the drum 37.

As a result, the flexible guide 383 can prevent or reduce an occurrence of a jam of the banknote 100 in the banknote storage device 3.

In addition, the flexible guide 383 has a triangular shape with its tip part obliquely inclined, and thus, even if the banknote 100 fed out from the drum 37 is torn, and the torn portion is folded over the second tape 352, the flexible guide 383 can unfold again the folded torn portion as the torn portion moves along the obliquely inclined tip part. This also makes it possible to suppress or reduce a jam of the banknote 100.

(Second Embodiment of Banknote Storage Device)

The abovementioned banknote storage device 3 has three reels 361, 362, and 363, but the technique disclosed herein is not limited to be applied to the banknote storage device 3 having the above configuration. For example, the technique disclosed herein may be applied to a banknote storage device 3 having four reels. The second embodiment of the banknote storage device 3 will now be described with reference to the drawings.

The banknote storage device 3 according to the second embodiment may have the same configuration in the side view as the banknote storage device 3 illustrated in FIGS. 3 and 4. However, since there are four tapes, the banknote storage device 3 has a total of four reels. Further, the paths of the four tapes are different from those of the banknote storage device 3 described above.

Figure 16:
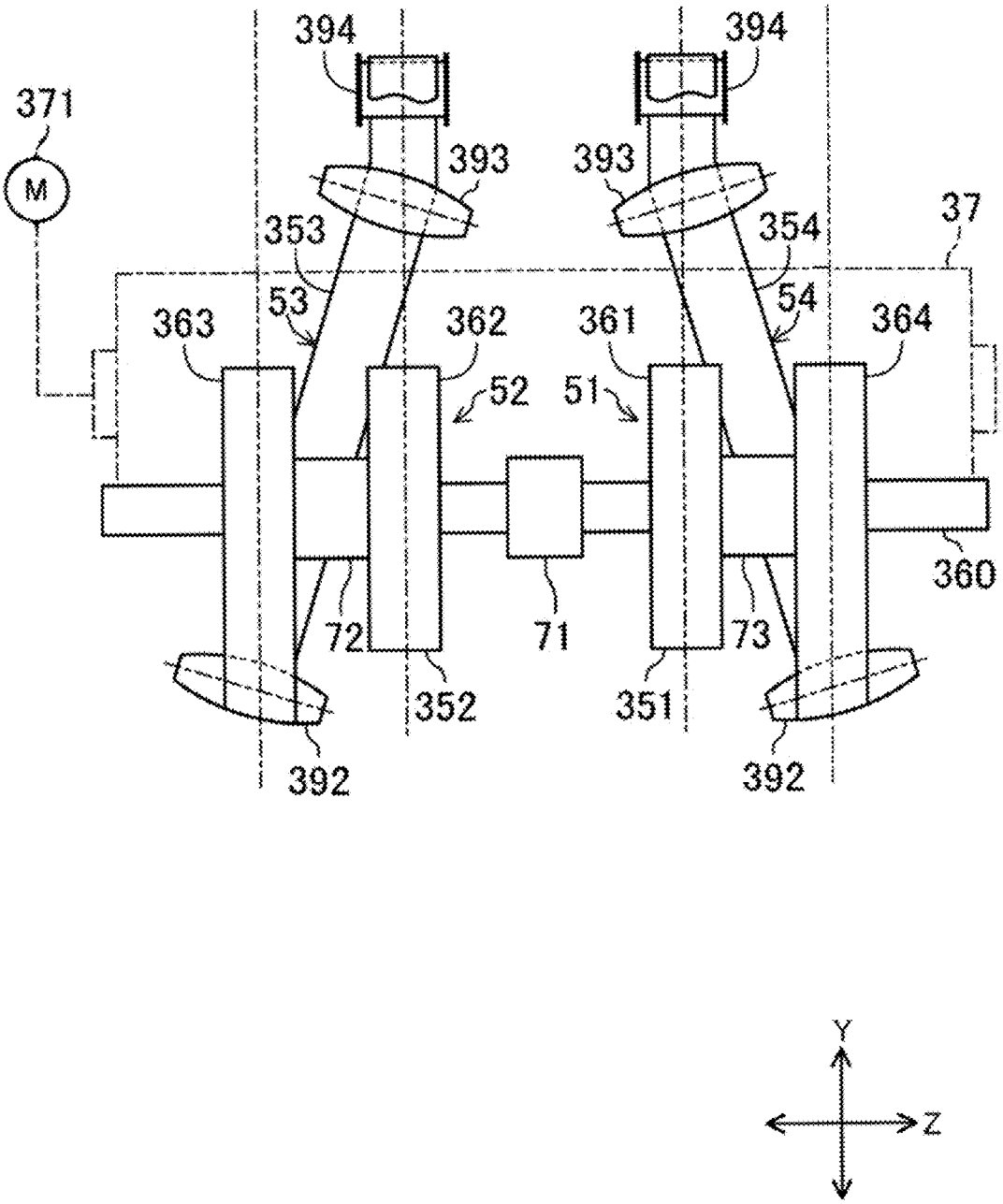
FIG. 16 is an explanatory diagram illustrating the configuration of a tape path of a banknote storage device according to a second embodiment.
Figure 17:
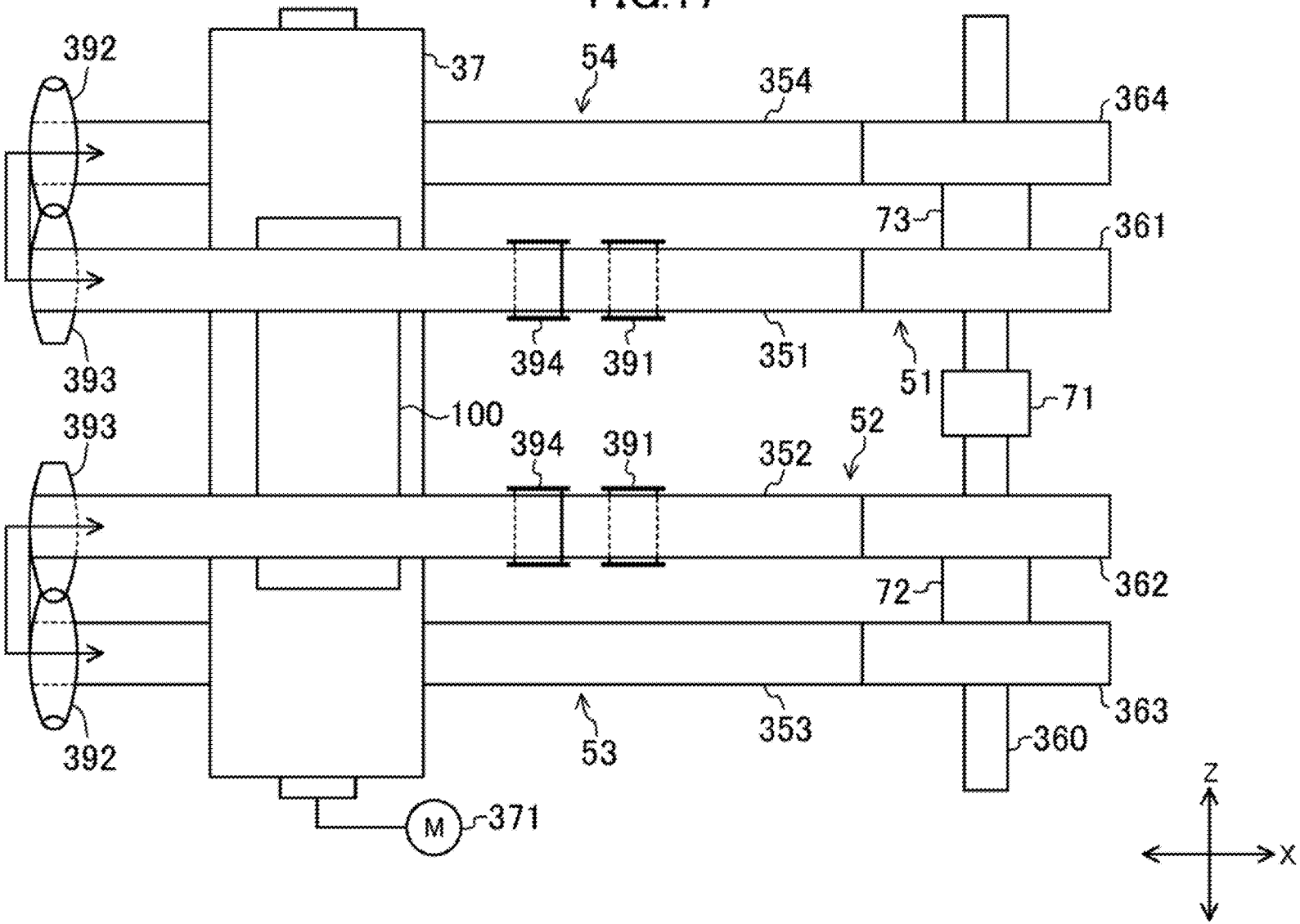
FIG. 17 is an explanatory diagram illustrating the configuration of the tape path of the banknote storage device according to the second embodiment.

As shown in FIGS. 16 and 17, the four reels 361, 362, 363, and 364 are aligned in the Z direction with respect to the shaft 360. More specifically, the fourth reel 364, the first reel 361, the second reel 362, and the third reel 363 are arranged in this order from the right side to the left side of the shaft 360.

From among the first tape 351, the second tape 352, the third tape 353, and the fourth tape 354 respectively unwound from the four reels 361, 362, 363, and 364, the first tape 351 and the fourth tape 354 overlap in a tape path between the reels and the drum 37, and the second tape 352 and the third tape 353 overlap in the tape path between the reels and the drum 37. The banknote 100 is sandwiched between the first tape 351 and the fourth tape 354 which overlap each other and between the second tape 352 and the third tape 353 which overlap each other, and is wound around the drum 37.

The configuration of the tape path in the banknote storage device 3 according to the second embodiment will be described below. FIGS. 16 and 17 illustrate the arrangement configuration of the reels and the tapes in the banknote storage device 3 according to the second embodiment. FIG. 16 corresponds to a side view when the inside of the banknote storage device 3 is viewed from the right side of the paper of FIG. 3, and FIG. 17 corresponds to a plan view when the inside of the banknote storage device 3 is viewed from the upper side of the paper of FIG. 3.

The first tape 351 unwound from the first reel 361 runs along a first tape path 51 to reach the drum 37. The fourth tape 354 unwound from the fourth reel 364 runs along a fourth tape path 54 to reach the drum 37. The first tape path 51 is comprised of the movable pulley 391 and the pulley pair 34. The fourth tape path 54 is comprised of the guide pulleys 392, 393, and 394, and the pulley pair 34.

Similarly, the second tape 352 unwound from the second reel 362 runs along the second tape path 52 to reach the drum 37. The third tape 353 unwound from the third reel 363 runs along a third tape path 53 to reach the drum 37. The second tape path 52 is comprised of the movable pulley 391 and the pulley pair 34. The third tape path 53 is comprised of the guide pulleys 392, 393, and 394 and the pulley pair 34.

In the banknote storage device 3 according to the second embodiment, the third tape path 53 is provided with a changing mechanism for changing the position of the third tape 353 in a direction parallel to the rotation axis of the drum 37. The changing mechanism is composed of the guide pulleys 392, 393 and 394. Similarly, the fourth tape path 54 is provided with a changing mechanism for changing the position of the fourth tape 354 in a direction parallel to the rotation axis of the drum 37.

The first tape path 51 and the second tape path 52 are arranged symmetrically with respect to a plane intersecting the center of the drum 37. Further, the third tape path 53 and the fourth tape path 54 are arranged symmetrically with respect to the plane intersecting the center of the drum 37.

As shown in FIG. 16, the first guide pulley 392 of the third tape path 53 is located at the same or substantially same position as the arrangement position of the third reel 363 in the Z direction. The rotation axis of the first guide pulley 392 is tilted with respect to the rotation axis of the third reel 363. More specifically, the rotation axis of the first guide pulley 392 is tilted so that the outer side is higher and the central side is lower in the Z direction. The first guide pulley 392 changes the running direction of the third tape 353, which is unwound straight from the third reel 363 in the X direction, from the X direction to the Y direction (to be exact, the direction inclined with respect to the Y direction) (see also FIG. 3).

The second guide pulley 393 of the third tape path 53 is located at the same or substantially same position as the arrangement position of the second reel 362 in the Z direction. The rotation axis of the second guide pulley 393 is tilted with respect to the rotation axes of the third reel 363 and the second reel 362. More specifically, the rotation axis of the second guide pulley 393 is parallel to the rotation axis of the first guide pulley 392. Therefore, the rotation axis of the second guide pulley 393 is also tilted so that the outer side is higher and the central side is lower in the Z direction. The second guide pulley 393 changes the running direction of the third tape 353 from the Y direction (to be exact, the direction inclined with respect to the Y direction) to substantially the X direction.

In the third tape path 53, the third tape 353 unwound from the third reel 363 is wound on the first guide pulley 392 and the second guide pulley 393, so that the position of the third tape 353 in the Z direction is changed from the position of the third reel 363 to the position of the second reel 362 (see the arrow in FIG. 17). The first guide pulley 392 and the second guide pulley 393 which are arranged in parallel to each other constitute the changing mechanism for changing the position of the tape in a direction parallel to the rotation axis of the drum 37.

Here, the first guide pulley 392 and the second guide pulley 393 are crowned pulleys, respectively. That is, each of the first guide pulley 392 and the second guide pulley 393 has a crown shape in which the pulley surface in contact with the third tape 353 protrudes more in the central portion than in both ends in the pulley width direction. The crowned pulley has a function of moving the running position of the tape toward the center. The first guide pulley 392 and the second guide pulley 393 change the running position of the tape in the Z direction as described above, and due to the first guide pulley 392 and the second guide pulley 393 moving the running position of the tape toward the center, the tape can stably run. Note that each of the first guide pulley 392 and the second guide pulley 393 may be a crowned pulley with a flange.

As shown in FIG. 16, the third guide pulley 394 of the third tape path 53 is located at the same or substantially same position as the arrangement position of the second reel 362 in the Z direction. The third guide pulley 394 changes the running direction of the third tape 353 from the X direction to the Y direction. Unlike the first guide pulley 392 and the second guide pulley 393, the third guide pulley 394 is not a crowned pulley. The third guide pulley 394 may be, for example, a flat pulley with a flange having a flat pulley surface.

After being wound on the third guide pulley 394 in the third tape path 53, the third tape 353 reaches the pulley pair 34 described above. At this time, the third tape 353 is located at the same position as the second tape 352 in the Z direction. The pulley pair 34 guides the third tape 353 to the outer peripheral surface of the drum 37 with the third tape 353 superimposed on the second tape 352.

The fourth tape path 54 has substantially the same configuration as the third tape path 53. That is, the rotation axis of the first guide pulley 392 of the fourth tape path 54 is tilted with respect to the rotation axis of the fourth reel 364. The first guide pulley 392 changes the running direction of the fourth tape 354, which is unwound straight from the fourth reel 364 in the X direction, from the X direction to the Y direction (to be exact, the direction inclined with respect to the Y direction).

The rotation axis of the second guide pulley 393 of the fourth tape path 54 is parallel to the rotation axis of the first guide pulley 392. The second guide pulley 393 changes the running direction of the fourth tape 354 from the Y direction (to be exact, the direction inclined with respect to the Y direction) to substantially the X direction.

The third guide pulley 394 of the fourth tape path 54 is located at the same or substantially same position as the arrangement position of the first reel 361 in the Z direction. The third guide pulley 394 changes the running direction of the fourth tape 354 from the X direction to the Y direction.

After being wound on the third guide pulley 394 in the fourth tape path 54, the fourth tape 354 reaches the pulley pair 34. At this time, the fourth tape 354 is located at the same position as the first tape 351 in the Z direction. The pulley pair 34 guides the fourth tape 354 to the outer peripheral surface of the drum 37 with the fourth tape 354 superimposed on the first tape 351.

The banknote 100 is held between the first tape 351 and the fourth tape 354 and between the second tape 352 and the third tape 353 at the pulley pair 34. Both ends of the banknote 100 in the longitudinal direction are sandwiched by pairs of tapes, respectively. After passing through the pulley pair 34, the banknote 100 is wound around the outer peripheral surface of the drum 37 together with the first tape 351, the fourth tape 354, the second tape 352, and the third tape 353.

It should be noted that the banknote 100 may be held by four tapes which are displaced in the axial direction of the drum 37 without providing the changing mechanism for changing the positions of the tapes in the paths of the tapes.

(Configuration of Torque Distribution Mechanism)

Figure 18:
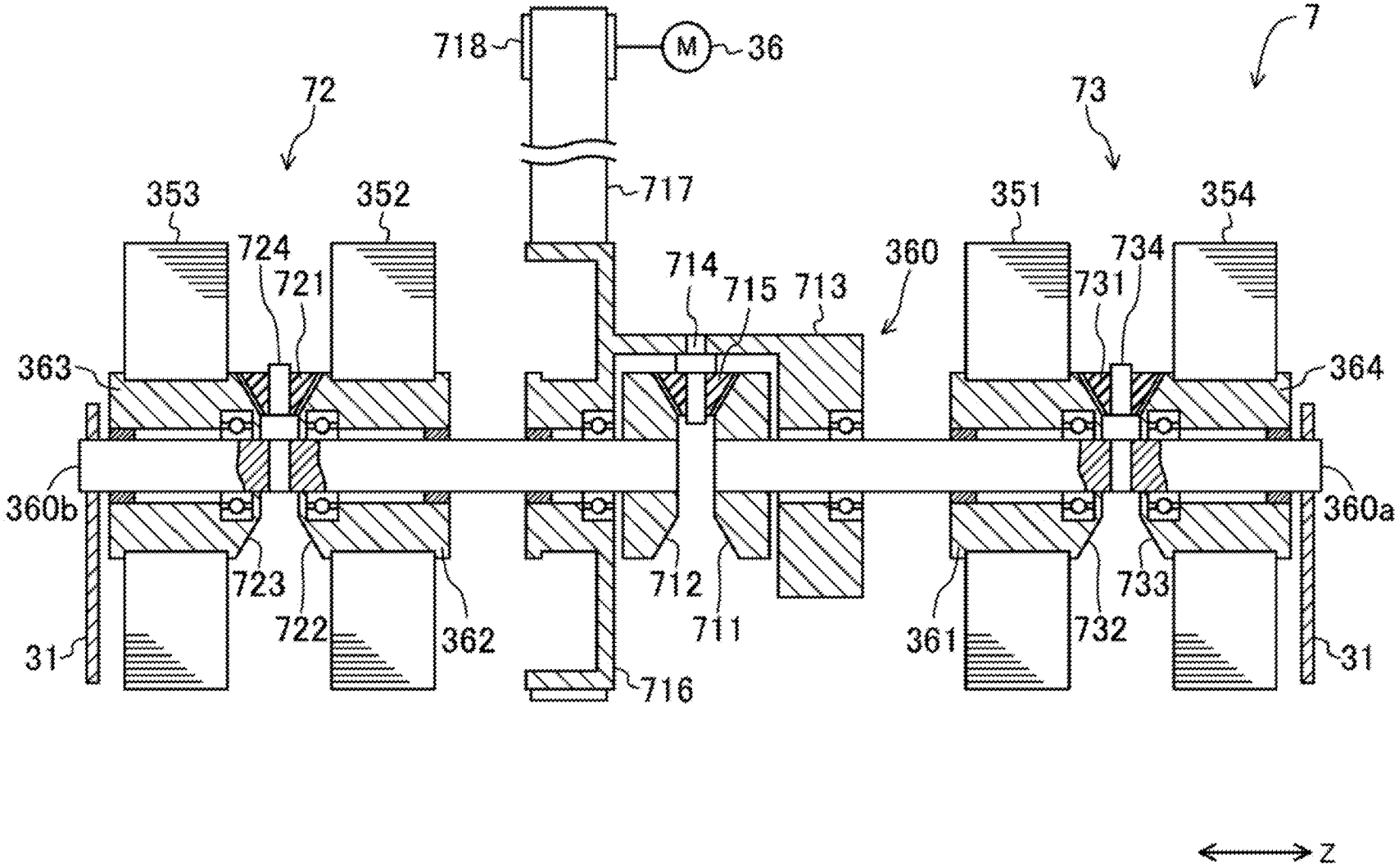
FIG. 18 is a vertical cross-sectional view illustrating the configuration of a torque distribution mechanism according to the second embodiment.

FIG. 18 illustrates the configuration of a torque distribution mechanism 7 provided in the banknote storage device 3 according to the second embodiment.

The torque distribution mechanism 7 includes a first differential mechanism 71, a second differential mechanism 72, and a third differential mechanism 73. The first differential mechanism 71, the second differential mechanism 72, and the third differential mechanism 73 each include a bevel gear.

In this configuration, the shaft 360 is divided into a first shaft 360*a* and a second shaft 360*b* which are coaxially arranged. The first differential mechanism 71 has a first side gear 711 fixed to the first shaft 360*a*, a second side gear 712 fixed to the second shaft 360*b*, and a pinion case 713.

The first side gear 711 is a bevel gear. The first side gear 711 is fixed to the base end of the first shaft 360*a*. The first side gear 711 rotates with the first shaft 360*a*.

The second side gear 712 is a bevel gear. The second side gear 712 is fixed to the tip of the second shaft 360*b*. The second side gear 712 rotates with the second shaft 360*b*. The second side gear 712 faces the first side gear 711. The number of teeth of the second side gear 712 and the number of teeth of the first side gear 711 are the same.

The pinion case 713 is supported by the first shaft 360*a* and the second shaft 360*b* via bearings. The pinion case 713 can rotate relative to the first shaft 360*a* and the second shaft 360*b*. A pin 714 is fixed to the pinion case 713. The pin 714 is provided so as to be perpendicular to the first shaft 360*a* and the second shaft 360*b*. A pinion gear 715 is attached to the pin 714. The pinion gear 715 is located between the first side gear 711 and the second side gear 712. The pinion gear 715 meshes with each of the first side gear 711 and the second side gear 712. The pinion gear 715 spins around the pin 714. When the pinion case 713 rotates, the pinion gear 715 revolves around the first shaft 360*a* and the second shaft 360*b*.

A driven roller 716 is integrally provided on the pinion case 713. A belt 717 is wound on the driven roller 716. The belt 717 is wound around a drive roller 718 attached to the rotation shaft of the electric motor 36. When the electric motor 36 as a torque source is operated, the torque of the electric motor 36 is input to the pinion case 713 via the belt 717.

The first differential mechanism 71 equally distributes the torque of the electric motor 36 input to the pinion case 713 to the first shaft 360*a* and the second shaft 360*b*. The path from the pinion gear 715 to the first shaft 360*a* via the first side gear 711 corresponds to a first path. The path from the pinion gear 715 to the second shaft 360*b* via the second side gear 712 corresponds to a second path. The first differential mechanism 71 also absorbs the speed difference between the first shaft 360*a* and the second shaft 360*b*.

The second differential mechanism 72 is provided on the second shaft 360*b*. The second differential mechanism 72 is provided between the second reel 362 and the third reel 363. The configuration of the second differential mechanism 72 is substantially the same as the configuration of the second differential mechanism 62 described above. The second differential mechanism 72 has a first pinion gear 721, a first side gear 722, and a second side gear 723. The first pinion gear 721 is rotatably supported by a pin 724 fixed perpendicularly to the second shaft 360*b*. The first pinion gear 721 rotates and revolves. The first side gear 722 is formed on the side surface of the second reel 362. The second side gear 723 is formed on the side surface of the third reel 363.

The second differential mechanism 72 equally distributes the torque input to the second shaft 360*b* to the second reel 362 and the third reel 363 via the first pinion gear 721, the first side gear 722, and the second side gear 723. The path from the first pinion gear 721 to the second reel 362 via the first side gear 722 corresponds to a third path. The path from the first pinion gear 721 to the third reel 363 via the second side gear 723 corresponds to a fourth path. The torque input to the second shaft 360*b* is ½T of the torque T of the electric motor 36. Therefore, the second differential mechanism 72 transmits ¼(=½×½)T of the torque T from the electric motor 36 to each of the second reel 362 and the third reel 363.

The third differential mechanism 73 is provided on the first shaft 360*a*. The configuration of the third differential mechanism 73 is substantially the same as the configuration of the second differential mechanism 72. The third differential mechanism 73 is provided between the first reel 361 and the fourth reel 364. The third differential mechanism 73 has a second pinion gear 731, a third side gear 732, and a fourth side gear 733. The second pinion gear 731 is rotatably supported by a pin 734 fixed perpendicularly to the first shaft 360*a*. The second pinion gear 731 rotates and revolves. The third side gear 732 is formed on the side surface of the first reel 361. The fourth side gear 733 is formed on the side surface of the fourth reel 364.

The third differential mechanism 73 equally distributes the torque input to the first shaft 360*a* to the first reel 361 and the fourth reel 364 via the second pinion gear 731, the third side gear 732, and the fourth side gear 733. The path from the second pinion gear 731 to the first reel 361 via the third side gear 732 corresponds to a fifth path. The path from the second pinion gear 731 to the fourth reel 364 via the fourth side gear 733 corresponds to a sixth path. The torque input to the first shaft 360*a* is ½T of the torque T of the electric motor 36. Therefore, the third differential mechanism 73 transmits ¼(=½×½)T of the torque T from the electric motor 36 to each of the first reel 361 and the fourth reel 364.

When the speeds of the four tapes are not equal, the first differential mechanism 71, the second differential mechanism 72, and the third differential mechanism 73 can absorb the speed difference by the rotation of the pinion gears 715, 721, and 731. Optimal torque is applied to each of the first reel 361, the second reel 362, the third reel 363, and the fourth reel 364. As a result, the tensions generated on the four tapes are constantly equal or substantially equal, even when the diameter of the drum 37 in the axial direction is non-uniform.

Note that the temporary storage unit 50 of the banknote processing device 1 may have the same configuration as the banknote storage device 3 illustrated in FIGS. 3 to 18. The temporary storage unit 50 is an example of a sheet storage device.

Figure 19:
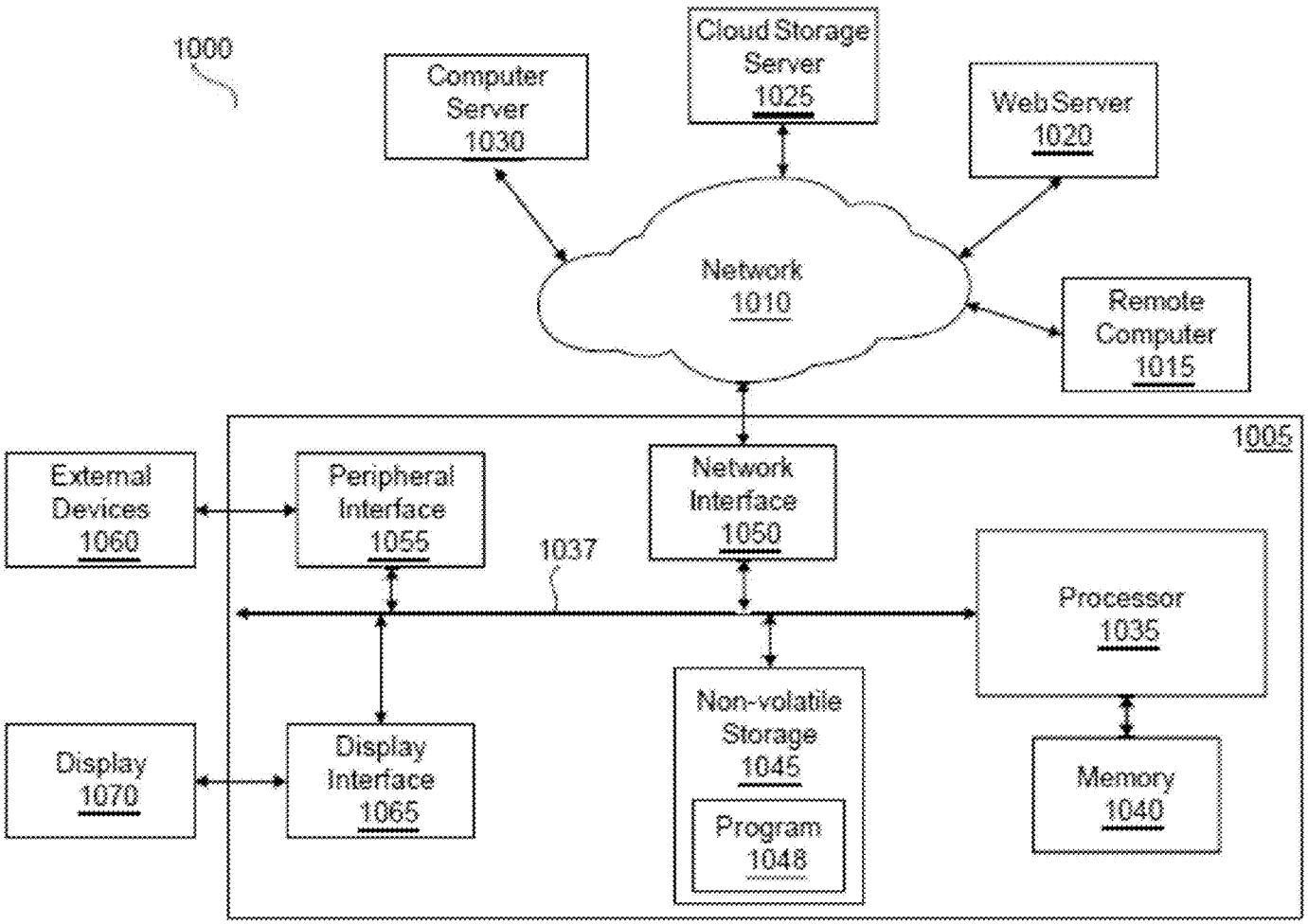
FIG. 19 is a block diagram of computer-based circuitry that may be used to implement control features of the present disclosure.

FIG. 19 illustrates a block diagram of a computer that may implement the various embodiments described herein. The present disclosure may be embodied as a system, a method, and/or a computer program product. The computer program product may include a non-transitory computer readable storage medium on which computer readable program instructions are recorded that may cause one or more processors to carry out aspects of the embodiment. For example, a controller or control system as described above for controlling components of banknote processing device 1 as well as attached components may be configured to include various elements depicted in FIG. 19.

The non-transitory computer readable storage medium may be a tangible device that can store instructions for use by an instruction execution device (processor). The computer readable storage medium may be, for example, but is not limited to, an electronic storage device, a magnetic storage device, an optical storage device, an electromagnetic storage device, a semiconductor storage device, or any appropriate combination of these devices. A non-exhaustive list of more specific examples of the computer readable storage medium includes each of the following (and appropriate combinations): flexible disk, hard disk, solid-state drive (SSD), random access memory (RAM), read-only memory (ROM), erasable programmable read-only memory (EPROM or Flash), static random access memory (SRAM), compact disc (CD or CD-ROM), digital versatile disk (DVD) and memory card or stick. A computer readable storage medium, as used in this disclosure, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described in this disclosure can be downloaded to an appropriate computing or processing device from a computer readable storage medium or to an external computer or external storage device via a global network (i.e., the Internet), a local area network, a wide area network and/or a wireless network. The network may include copper transmission wires, optical communication fibers, wireless transmission, routers, firewalls, switches, gateway computers and/or edge servers. A network adapter card or network interface in each computing or processing device may receive computer readable program instructions from the network and forward the computer readable program instructions for storage in a computer readable storage medium within the computing or processing device.

Computer readable program instructions for carrying out operations of the present disclosure may include machine language instructions and/or microcode, which may be compiled or interpreted from source code written in any combination of one or more programming languages, including assembly language, Basic, Fortran, Java, Python, R, C, C++, C# or similar programming languages. The computer readable program instructions may execute entirely on a user's personal computer, notebook computer, tablet, or smartphone, entirely on a remote computer or compute server, or any combination of these computing devices. The remote computer or compute server may be connected to the user's device or devices through a computer network, including a local area network or a wide area network, or a global network (i.e., the Internet). In some embodiments, electronic circuitry including, for example, programmable logic circuitry, field-programmable gate arrays (FPGA), or programmable logic arrays (PLA) may execute the computer readable program instructions by using information from the computer readable program instructions to configure or customize the electronic circuitry, in order to perform aspects of the present disclosure.

Aspects of the present disclosure are described herein with reference to flow diagrams and block diagrams of methods, apparatus (systems), and computer program products according to embodiments of the disclosure. It will be understood by those skilled in the art that each block of the flow diagrams and block diagrams, and combinations of blocks in the flow diagrams and block diagrams, can be implemented by computer readable program instructions.

The computer readable program instructions that may implement the systems and methods described in this disclosure may be provided to one or more processors (and/or one or more cores within a processor) of a general purpose computer, special purpose computer, or other programmable apparatus to produce a machine, such that the instructions, which execute via the processor of the computer or other programmable apparatus, create a system for implementing the functions specified in the flow diagrams and block diagrams in the present disclosure. These computer readable program instructions may also be stored in a computer readable storage medium that can direct a computer, a programmable apparatus, and/or other devices to function in a particular manner, such that the computer readable storage medium having stored instructions is an article of manufacture including instructions which implement aspects of the functions specified in the flow diagrams and block diagrams in the present disclosure.

The computer readable program instructions may also be loaded onto a computer, other programmable apparatus, or other device to cause a series of operational steps to be performed on the computer, other programmable apparatus or other device to produce a computer implemented process, such that the instructions which execute on the computer, other programmable apparatus, or other device implement the functions specified in the flow diagrams and block diagrams in the present disclosure.

FIG. 19 is a functional block diagram illustrating a networked system 1000 of one or more networked computers and servers. In an embodiment, the hardware and software environment illustrated in FIG. 19 may provide an exemplary platform for implementation of the software and/or methods according to the present disclosure.

Referring to FIG. 19, a networked system 1000 may include, but is not limited to, computer 1005, network 1010, remote computer 1015, web server 1020, cloud storage server 1025 and compute server 1030. In some embodiments, multiple instances of one or more of the functional blocks illustrated in FIG. 19 may be employed.

Additional detail of computer 1005 is shown in FIG. 19. The functional blocks illustrated within computer 1005 are provided only to establish exemplary functionality and are not intended to be exhaustive. And while details are not provided for remote computer 1015, web server 1020, cloud storage server 1025 and compute server 1030, these other computers and devices may include similar functionality to that shown for computer 1005.

Computer 1005 may be a personal computer (PC), a desktop computer, laptop computer, tablet computer, netbook computer, a personal digital assistant (PDA), a smart phone, or any other programmable electronic device capable of communicating with other devices on network 1010.

Computer 1005 may include processor 1035, bus 1037, memory 1040, non-volatile storage 1045, network interface 1050, peripheral interface 1055 and display interface 1065. Each of these functions may be implemented, in some embodiments, as individual electronic subsystems (integrated circuit chip or combination of chips and associated devices), or, in other embodiments, some combination of functions may be implemented on a single chip (sometimes called a system on chip or SoC).

Processor 1035 may be one or more single or multi-chip microprocessors, such as those designed and/or manufactured by Intel Corporation, Advanced Micro Devices, Inc. (AMD), Arm Holdings (Arm), Apple Computer, etc. Examples of microprocessors include Celeron, Pentium, Core i3, Core i5 and Core i7 from Intel Corporation; Opteron, Phenom, Athlon, Turion and Ryzen from AMD; and Cortex-A, Cortex-R and Cortex-M from Arm.

Bus 1037 may be a proprietary or industry standard high-speed parallel or serial peripheral interconnect bus, such as ISA, PCI, PCI Express (PCI-e), AGP, and the like.

Memory 1040 and non-volatile storage 1045 may be computer-readable storage media. Memory 1040 may include any suitable volatile storage devices such as Dynamic Random Access Memory (DRAM) and Static Random Access Memory (SRAM). Non-volatile storage 1045 may include one or more of the following: flexible disk, hard disk, solid-state drive (SSD), read-only memory (ROM), erasable programmable read-only memory (EPROM or Flash), compact disc (CD or CD-ROM), digital versatile disk (DVD) and memory card or stick.

Program 1048 may be a collection of machine readable instructions and/or data that is stored in non-volatile storage 1045 and is used to create, manage and control certain software functions that are discussed in detail elsewhere in the present disclosure and illustrated in the drawings. In some embodiments, memory 1040 may be considerably faster than non-volatile storage 1045. In such embodiments, program 1048 may be transferred from non-volatile storage 1045 to memory 1040 prior to execution by processor 1035.

Computer 1005 may be capable of communicating and interacting with other computers via network 1010 through network interface 1050. Network 1010 may be, for example, a local area network (LAN), a wide area network (WAN) such as the Internet, or a combination of the two, and may include wired, wireless, or fiber optic connections. In general, network 1010 can be any combination of connections and protocols that support communications between two or more computers and related devices.

Peripheral interface 1055 may allow for input and output of data with other devices that may be connected locally with computer 1005. For example, peripheral interface 1055 may provide a connection to external devices 1060. External devices 1060 may include devices such as a keyboard, a mouse, a keypad, a touch screen, and/or other suitable input devices. External devices 1060 may also include portable computer-readable storage media such as, for example, thumb drives, portable optical or magnetic disks, and memory cards. Software and data used to practice embodiments of the present disclosure, for example, program 1048, may be stored on such portable computer-readable storage media. In such embodiments, software may be loaded onto non-volatile storage 1045 or, alternatively, directly into memory 1040 via peripheral interface 1055. Peripheral interface 1055 may use an industry standard connection, such as RS-232 or Universal Serial Bus (USB), to connect with external devices 1060.

Display interface 1065 may connect computer 1005 to display 1070. Display 1070 may be used, in some embodiments, to present a command line or graphical user interface to a user of computer 1005. Display interface 1065 may connect to display 1070 using one or more proprietary or industry standard connections, such as VGA, DVI, DisplayPort and HDMI.

As described above, network interface 1050, provides for communications with other computing and storage systems or devices external to computer 1005. Software programs and data discussed herein may be downloaded from, for example, remote computer 1015, web server 1020, cloud storage server 1025 and compute server 1030 to non-volatile storage 1045 through network interface 1050 and network 1010. Furthermore, the systems and methods described in this disclosure may be executed by one or more computers connected to computer 1005 through network interface 1050 and network 1010. For example, in some embodiments the systems and methods described in this disclosure may be executed by remote computer 1015, computer server 1030, or a combination of the interconnected computers on network 1010.

Data, datasets and/or databases employed in embodiments of the systems and methods described in this disclosure may be stored and or downloaded from remote computer 1015, web server 1020, cloud storage server 1025 and compute server 1030.

Further, the technique disclosed herein is not limited to being applied to a banknote processing device and a banknote storage device. The technology disclosed herein can be widely applied to, for example, a sheet processing device that handles sheets, such as checks, coupons, and various kinds of securities, and to a sheet storage device.

What is claimed is:

1. A sheet storage device, comprising:

a first reel around which a first tape is wound;

a second reel around which a second tape is wound;

a third reel around which a third tape is wound;

a shaft that is rotatable about a shaft axis extending in an axis direction and that supports the first reel, the second reel, and the third reel;

a drum to wind up therearound sheets together with the first tape, the second tape and the third tape, the drum being rotatable about a drum axis extending in the axis direction and to which a tip of each of the first tape, the second tape and the third tape is fixed;

a torque source to generate torque;

a first differential to distribute the torque generated by the torque source to a first path for transmitting the torque distributed by the first differential to the first reel and a second path for transmitting the torque distributed by the first differential to the second reel and the third reel; and a second differential to distribute the torque distributed by the first differential from the second path to a third path for transmitting the torque distributed by the second differential to the second reel and a fourth path for transmitting the torque distributed from the second differential to the third reel, wherein the first differential and the second differential equally distributes the torque to the first reel, the second reel and the third reel.

2. The sheet storage device of claim 1, wherein the first differential includes a planetary gear, and the second differential includes a bevel gear.

3. The sheet storage device of claim 2, wherein the first differential further includes a sun gear, a ring gear, and a carrier that supports the planetary gear, the planetary gear meshes with the sun gear and the ring gear, the torque from the torque source is input to the carrier, the first reel is connected to the sun gear so as to rotate integrally with the sun gear, and the ring gear is fixed to the shaft so as to rotate integrally with the shaft.

4. The sheet storage device of claim 3, wherein a gear ratio between the sun gear and the ring gear is 1/2.

5. The sheet storage device of claim 3, wherein the first differential is located at an end of the shaft, the first reel is located adjacent to the first differential, and the first reel and the sun gear are connected by a pipe fitted onto the shaft.

6. The sheet storage device of claim 2, wherein the second differential includes a pinion gear rotatably supported by a pin fixed perpendicularly to the shaft, a first side gear that rotates integrally with the second reel and meshes with the pinion gear, and a second side gear that rotates integrally with the third reel and meshes with the pinion gear.

7. The sheet storage device of claim 1, further comprising:

a fourth reel around which a fourth tape is wound; and a third differential that is provided in the first path and distributes the torque distributed by the first differential to a fifth path and a sixth path, wherein the fourth reel is rotatably supported by the shaft, a tip of the fourth tape unwound from the fourth reel is fixed to the drum, the first reel is located in the fifth path, and the fourth reel is located in the sixth path.

8. The sheet storage device of claim 7, wherein the first differential, the second differential, and the third differential each include a bevel gear.

9. The sheet storage device of claim 8, wherein the shaft is divided into a first shaft and a second shaft that are coaxially arranged, the first differential includes a first side gear fixed to the first shaft, a second side gear fixed to the second shaft, a pinion case rotatably supported by the first shaft and the second shaft, and a pinion gear rotatably supported by a pin, which is fixed to the pinion case so as to be perpendicular to the shaft, the pinion gear meshing with each of the first side gear and the second side gear, and the torque from the torque source is input to the pinion case.

10. The sheet storage device of claim 9, wherein the second differential includes a first pinion gear rotatably supported by a pin fixed perpendicularly to the second shaft, a first side gear that rotates integrally with the second reel and meshes with the first pinion gear, and a second side gear that rotates integrally with the third reel and meshes with the first pinion gear, and the third differential includes a second pinion gear rotatably supported by a pin fixed perpendicularly to the first shaft, a third side gear that rotates integrally with the first reel and meshes with the second pinion gear, and a fourth side gear that rotates integrally with the fourth reel and meshes with the second pinion gear.

11. The sheet storage device of claim 1, wherein the shaft is provided with the first differential and the second differential.

12. The sheet storage device of claim 1, wherein the first differential is disposed at one end of the shaft.

13. The sheet storage device of claim 1, wherein the second differential is provided between the second reel and the third reel.

14. The sheet storage device of claim 1, wherein the second differential equally distributes the torque to the second reel and the third reel.

15. The sheet storage device of claim 1, wherein the first differential and the second differential equally distributes the torque to the first reel, the second reel and the third reel so that a predetermined tension is generated in each of the first tape, the second tape and the third tape during rotation of the drum.

16. The sheet storage device of claim 1, wherein the first differential and the second differential equally distributes the torque to the first reel, the second reel and the third reel in corporation with each other.

* * * * *